US011666923B2

(12) United States Patent
Kumar et al.

(10) Patent No.: US 11,666,923 B2
(45) Date of Patent: Jun. 6, 2023

(54) SPLIT PULP CHAMBER INSERT ASSEMBLY

(71) Applicant: Polycorp Ltd., Elora (CA)

(72) Inventors: Pramod Kumar, Waterloo (CA); Robert Michael McPhee, Burlington (CA)

(73) Assignee: Polycorp Ltd., Elora (CA)

( * ) Notice: Subject to any disclaimer, the term of this patent is extended or adjusted under 35 U.S.C. 154(b) by 278 days.

(21) Appl. No.: 17/105,553

(22) Filed: Nov. 26, 2020

(65) Prior Publication Data

US 2021/0162423 A1 Jun. 3, 2021

Related U.S. Application Data

(60) Provisional application No. 62/941,775, filed on Nov. 28, 2019.

(51) Int. Cl.
*B02C 17/22* (2006.01)
*B02C 17/04* (2006.01)
*B02C 17/18* (2006.01)

(52) U.S. Cl.
CPC ..... *B02C 17/22* (2013.01); *B02C 17/04* (2013.01); *B02C 17/1825* (2013.01); *B02C 17/1855* (2013.01)

(58) Field of Classification Search
CPC ..... B02C 17/22; B02C 17/04; B02C 17/1825; B02C 17/1855
See application file for complete search history.

(56) References Cited

U.S. PATENT DOCUMENTS 3,599,882 A * 8/1971 Sabaski ..... B02C 17/18 241/70
4,165,041 A * 8/1979 Larsen ..... B02C 17/22 241/182
4,172,560 A * 10/1979 Butler ..... B02C 17/06 241/70
4,295,615 A * 10/1981 Mishek ..... B02C 17/22 241/182
5,161,745 A * 11/1992 Valeri ..... B02C 17/1855 241/299
5,361,997 A * 11/1994 Burkes ..... B02C 17/1855 241/70
8,308,906 B2 11/2012 Page et al.
8,360,350 B2 1/2013 Mepham et al.
9,289,775 B2 3/2016 Mepham et al.
10,427,164 B2 10/2019 Mepham et al.
(Continued)

FOREIGN PATENT DOCUMENTS

CA 2935241 A1 1/2017

*Primary Examiner* — Faye Francis

(57) ABSTRACT

A split pulp chamber insert assembly formed for installation in a pulp chamber on a discharge end wall in a grinding mill rotatable about an axis thereof. The split pulp chamber insert assembly include two or more insert elements, configured to cooperate to form a lining covering one or more portions of pulp chamber surfaces that partially define the pulp chamber in which the insert elements are positioned. The split pulp chamber assembly also includes a number of fasteners, for securing the insert elements in predetermined positions in the pulp chamber relative to each other to form the lining that covers the one or more portions of the pulp chamber surfaces.

15 Claims, 32 Drawing Sheets

(56) References Cited

U.S. PATENT DOCUMENTS

| | | | | |
|---|---|---|---|---|
| 2013/0105609 | A1* | 5/2013 | Fernandez | B02C 17/225<br>241/83 |
| 2017/0014831 | A1* | 1/2017 | Mepham | B02C 17/183 |
| 2018/0257082 | A1* | 9/2018 | Canabes Guerra | B02C 17/04 |
| 2019/0388900 | A1 | 12/2019 | McPhee et al. | |
| 2020/0023373 | A1 | 1/2020 | McPhee et al. | |

* cited by examiner

SPLIT PULP CHAMBER INSERT ASSEMBLY

CROSS-REFERENCE TO RELATED APPLICATION

This application claims the benefit of U.S. Provisional Patent Application No. 62/941,775, filed on Nov. 28, 2019, the entirety of which is hereby incorporated herein by reference.

FIELD OF THE INVENTION

The present invention is a split pulp chamber insert assembly for installation in a pulp chamber in a grinding mill.

BACKGROUND OF THE INVENTION

As disclosed in Canadian Patent No. 2,937,053, an insert may be positioned in a pulp chamber in a discharge end wall of a grinding mill, to mitigate the wear to which the surfaces of the discharge end wall (e.g., on pulp lifters positioned thereon) may be subjected.

In the prior art, the inserts are held in position by suitable fasteners. However, the pulp chamber inserts tend to become secured in position otherwise over time, e.g., partially by the fines and other materials that move through the pulp chamber, while the insert is located on the discharge end wall. Accordingly, removing the insert when it is due for replacement can be difficult.

SUMMARY OF THE INVENTION

For the foregoing reasons, there is a need for a split pulp chamber insert that overcomes or mitigates one or more of the disadvantages or defects of the prior art.

In its broad aspect, the invention provides a split pulp chamber insert assembly formed for installation in a pulp chamber on a discharge end wall in a grinding mill that is rotatable about an axis thereof. The split pulp chamber insert assembly includes two or more insert elements that are configured to cooperate to form a lining covering at least a portion of pulp chamber surfaces that partially define the pulp chamber. The split pulp chamber insert assembly also includes a number of fasteners for securing the insert elements in predetermined positions relative to each other to form the lining, covering the portion of the pulp chamber surfaces.

BRIEF DESCRIPTION OF THE DRAWINGS

The invention will be better understood with reference to the attached drawings, in which.

DETAILED DESCRIPTION

Figure 1A:
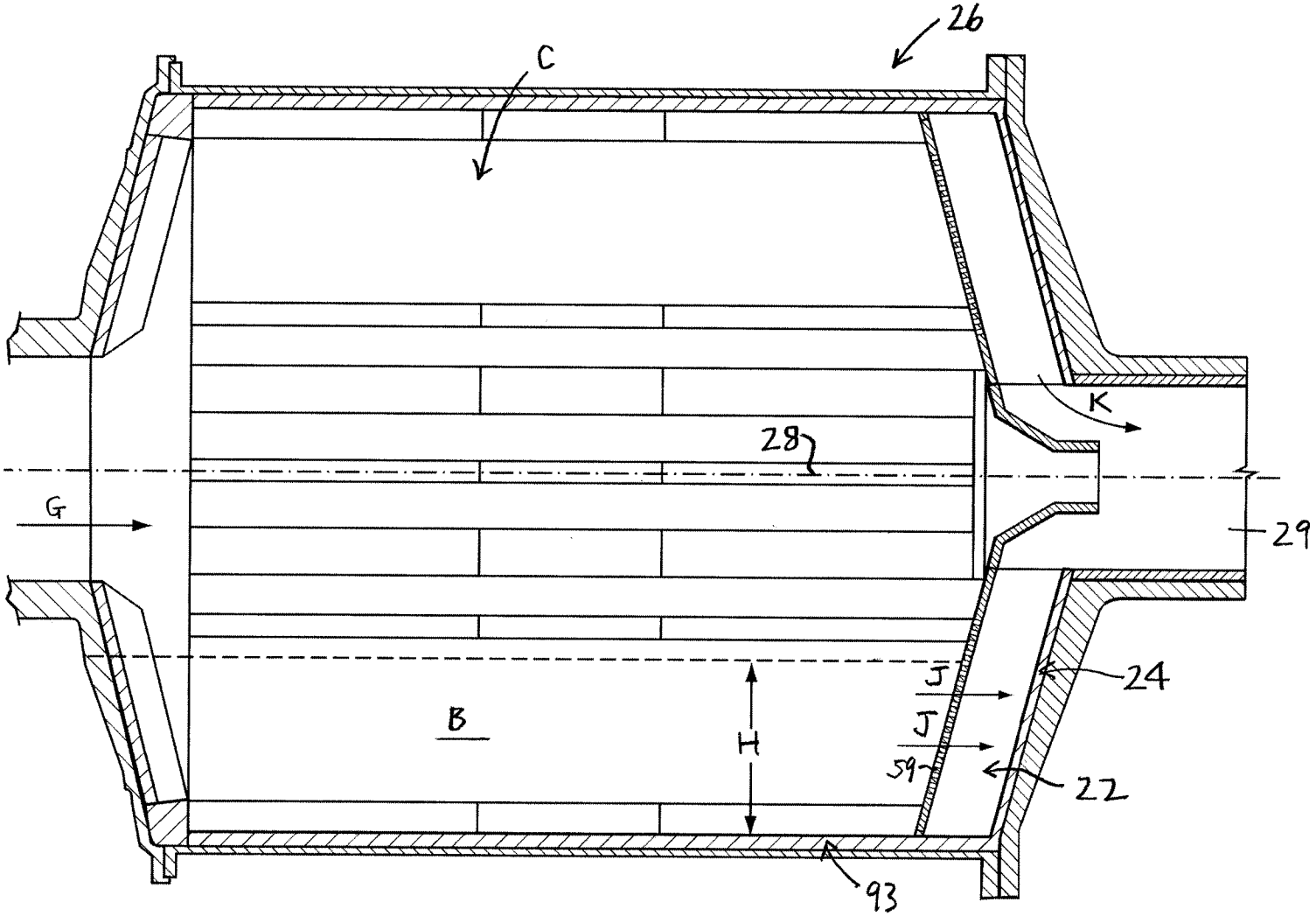
FIG. 1A (PRIOR ART)
FIG. 1A is a longitudinal cross-section of a grinding mill including a discharge end wall.

In the attached drawings, like reference numerals designate corresponding elements throughout. Reference is first made to FIGS. 1A-2A and 4A-4E to describe an embodiment of a split pulp chamber insert assembly in accordance with the invention indicated generally by the numeral 20.

Figure 1B:
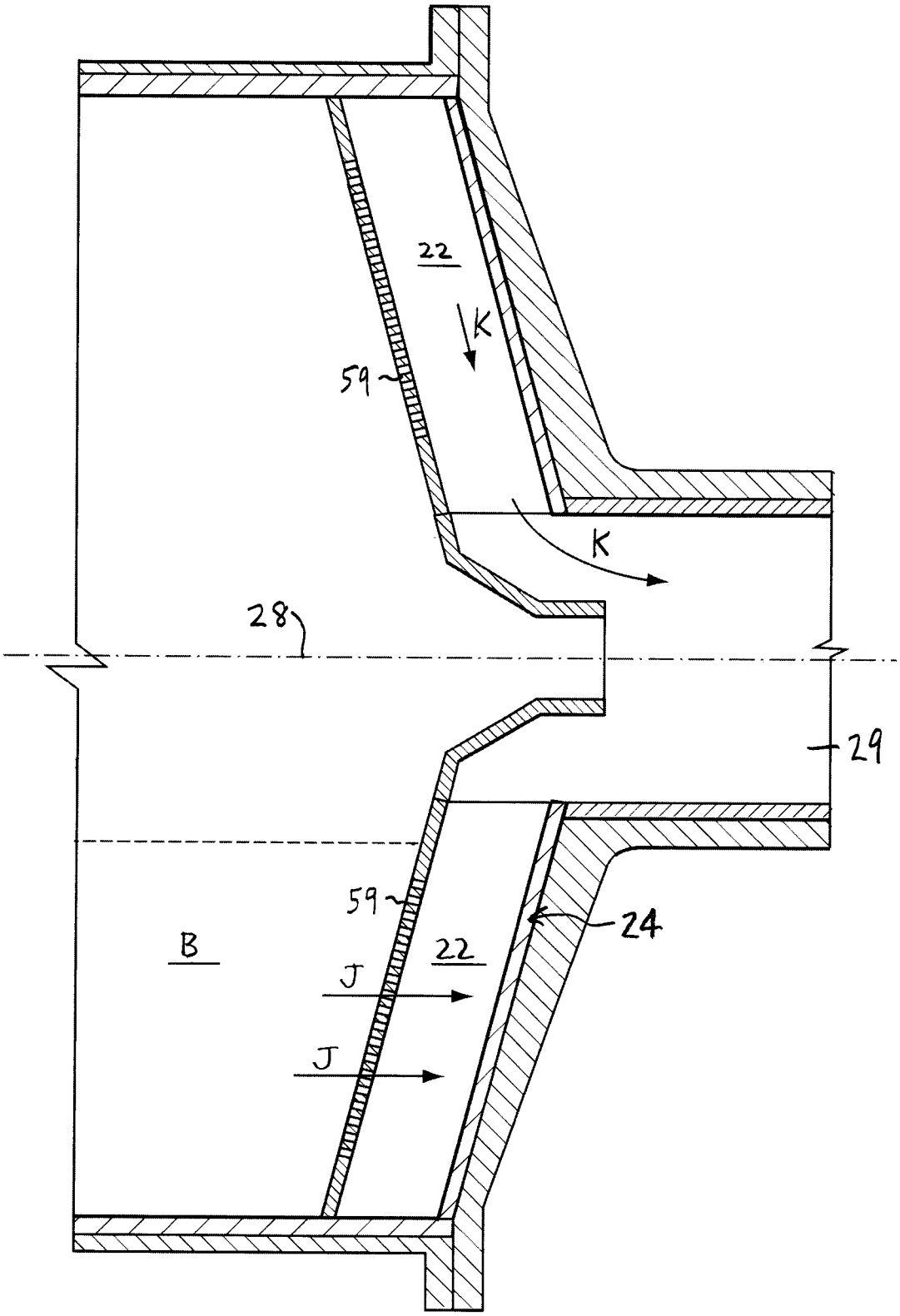
FIG. 1B (PRIOR ART)
FIG. 1B is a cross-section of the discharge end wall of the grinding mill of FIG. 1A, drawn at a larger scale.
Figure 1C:
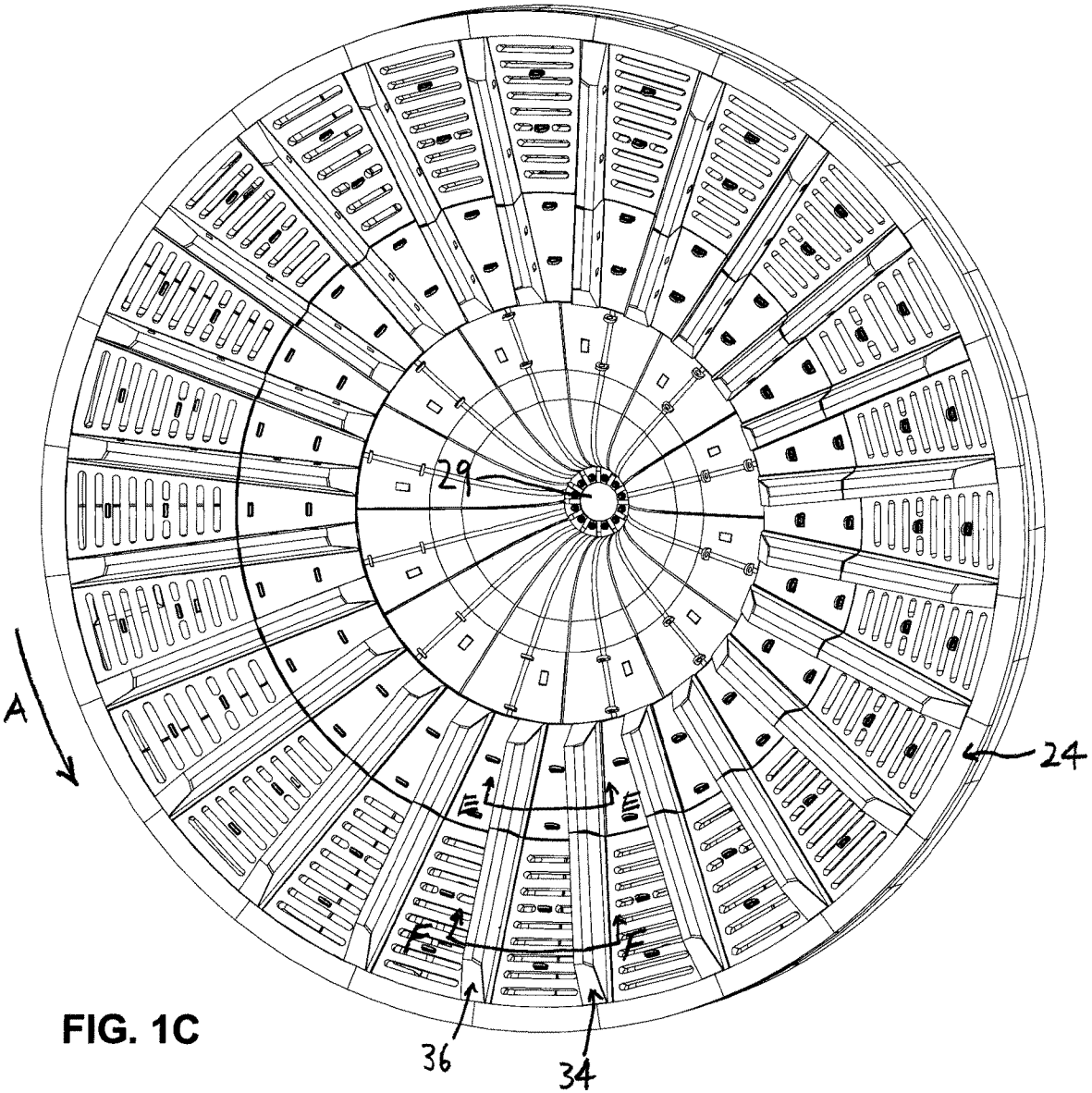
FIG. 1C is an elevation view of the discharge end wall of FIG. 1B.

As will be described, the split pulp chamber insert assembly 20 (FIG. 1D) is formed for installation in a pulp chamber 22 (FIG. 4A) on a discharge end wall 24 (FIGS. 1B, 1C) in a grinding mill 26 that is rotatable about an axis 28 thereof (FIG. 1A). In FIG. 1C, the direction of rotation about the axis 28 is indicated by arrow "A". The pulp chamber 22 is formed for directing slurry (not shown) received therein therethrough toward a discharge opening 29 in the discharge end wall 24 (FIGS. 1A-1C).

As can be seen in FIGS. 1F and 4A-4E, the pulp chamber 22 is partially defined by a number of pulp chamber surfaces "PCS". The pulp chamber surfaces "PCS" include surfaces "$IWS_1$", "$IWS_2$", of respective interior walls 30, 32 (FIGS. 1F, 4A-4E) of a pair of pulp lifters 34, 36 (FIG. 2A) mounted to the discharge end wall 24 and axially spaced apart from each other relative to the axis 28, and a floor surface 48 (FIGS. 1E, 1F) and an outer wall surface 50 (FIGS. 4C, 4D) located between the interior walls 30, 32.

Figure 1D:
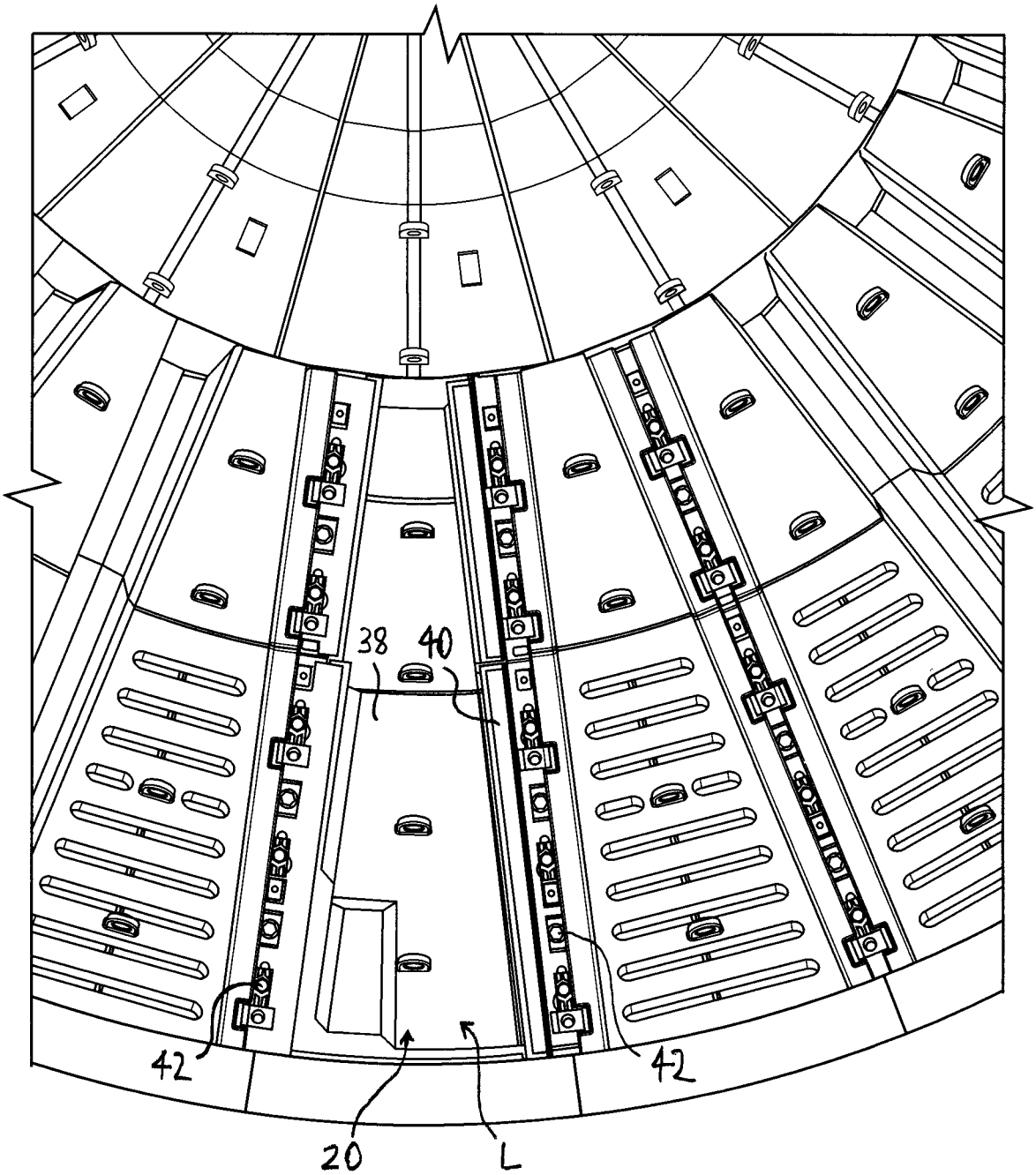
FIG. 1D is an isometric view of an embodiment of the split pulp chamber insert assembly of the invention including first and second insert elements installed in a pulp chamber.
Figure 1E:
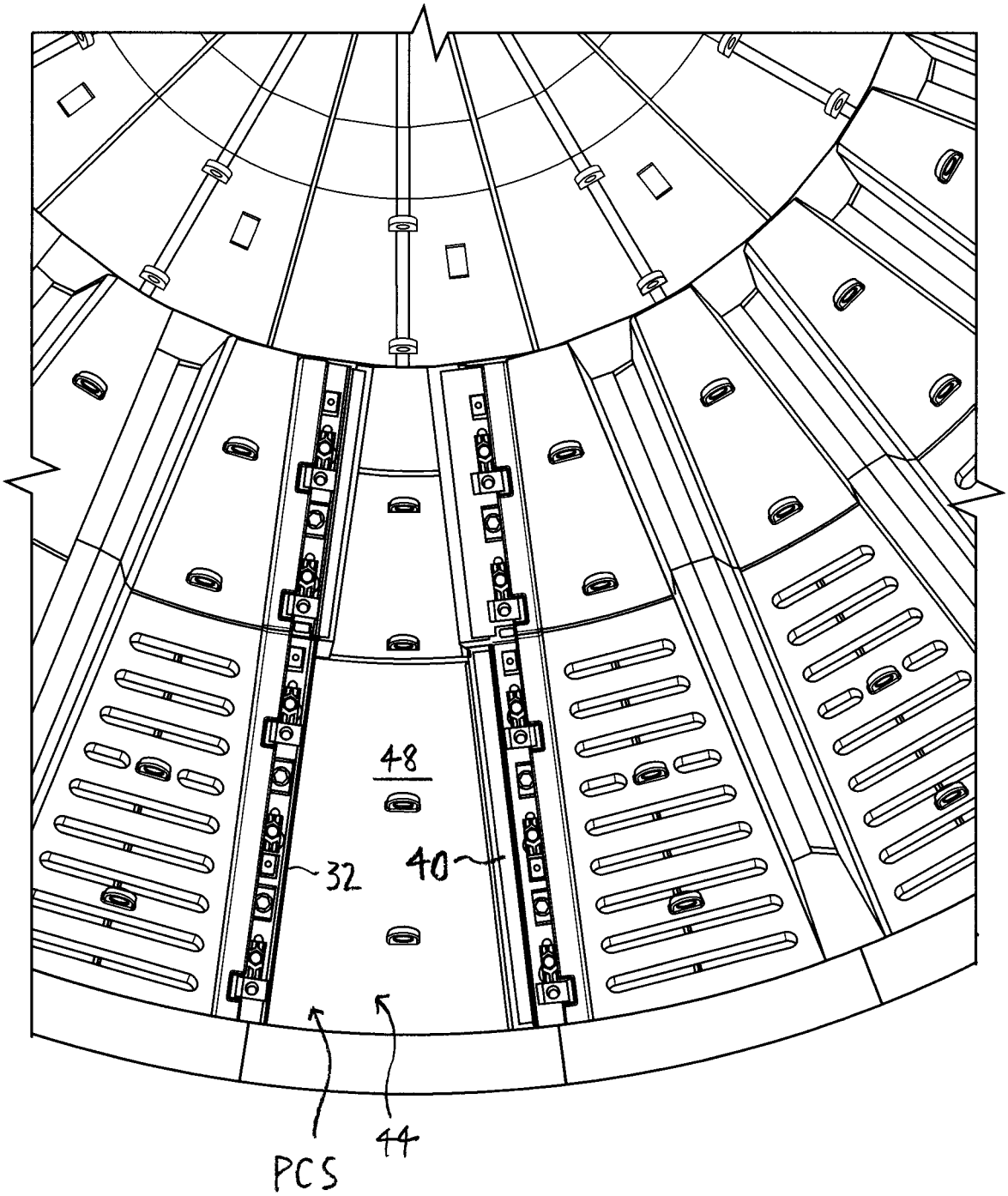
FIG. 1E is an isometric view of the second insert element of the split pulp chamber insert assembly of FIG. 1D installed in the pulp chamber, with the first insert element removed from the pulp chamber.
Figure 1F:
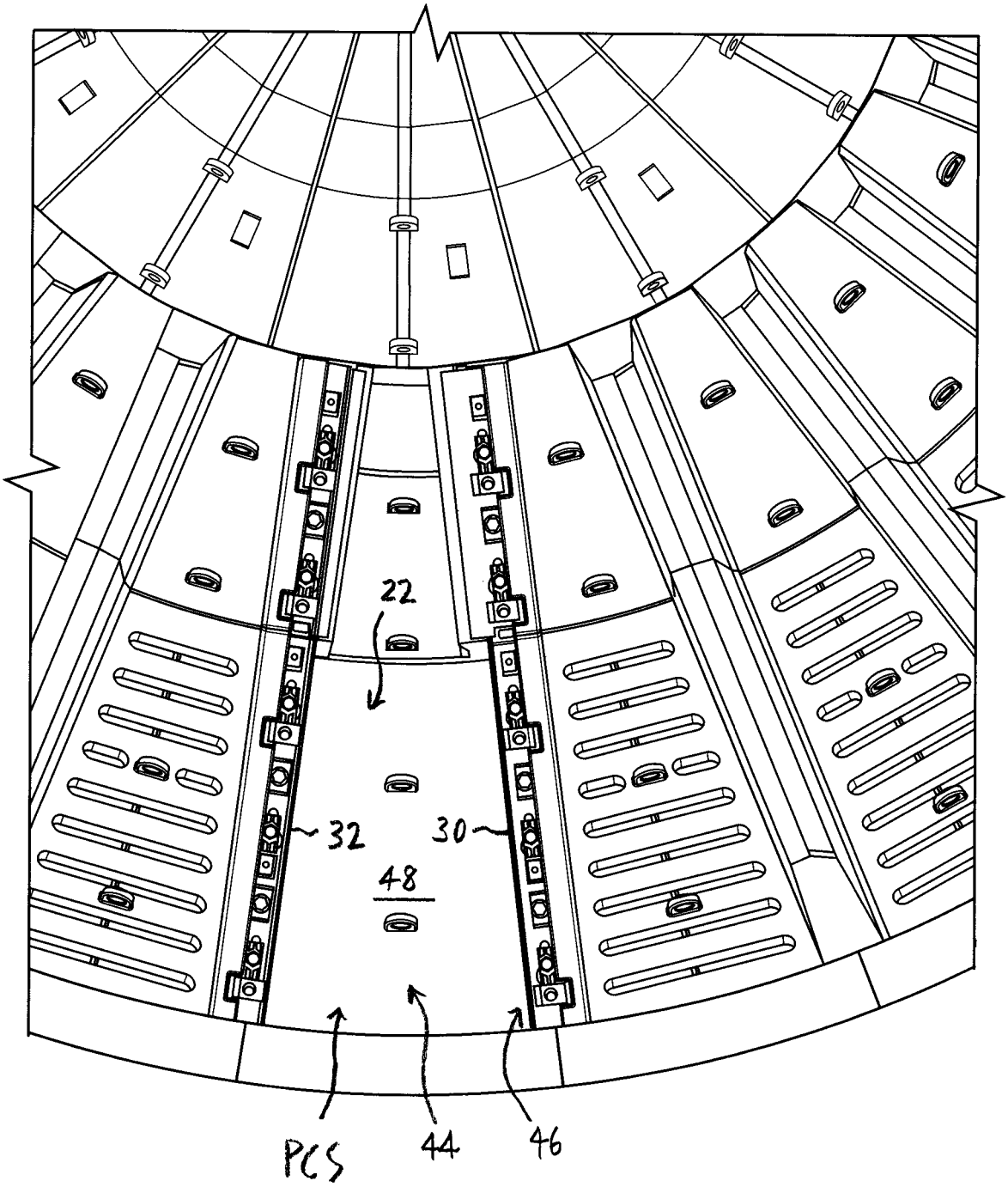
FIG. 1F is an isometric view of the pulp chamber of FIGS. 1D and 1E after the second insert element is also removed therefrom, to show a floor surface of the pulp chamber.

In one embodiment, the split pulp chamber insert assembly 20 preferably includes two or more insert elements 38, 40 (FIG. 1D). The insert elements 38, 40 preferably are configured to cooperate to form a lining "L" covering one or more portions of the pulp chamber surfaces "PCS" (FIGS. 1D-1F).

It is also preferred that the split pulp chamber insert assembly 20 includes a number of fasteners 42 (FIG. 1D). The fasteners 42 are for securing the insert elements 38, 40 to the pulp lifters 34, 36, to hold the insert elements 38, 40 in predetermined positions relative to each other to form the lining "L", covering the portion(s) of the pulp chamber surfaces "PCS". In one embodiment, the fasteners 42 secure the insert elements 38, 40 to the interior walls 32, 30 respectively.

As can be seen in FIG. 1D, the first insert element 38 preferably is configured for location thereof on a preselected first portion 44 (FIG. 1E) of the pulp chamber surfaces "PCS", to cover the first portion 44, as will be described. Preferably, the second insert element 40 is configured for location thereof on a preselected second portion 46 of the pulp chamber surfaces "PCS" (FIG. 1F).

It will be understood that each of the first portion 44 and the second portion 46 includes selected ones of the pulp chamber surfaces "PCS". Preferably, the first portion 44 includes the floor surface 48, the outer wall surface 50, and the interior wall surface "$IWS_2$" of the leading interior wall 32. The second portion 46 preferably includes the interior wall surface "$IWS_1$" of the trailing interior wall 30.

Preferably, the first and second elements 38, 40 are formed to cooperate with each other, when installed in the pulp chamber 22, to provide the lining "L" for the pulp chamber 22. From the foregoing, it can be seen that, once the first and second elements 38, 40 are installed, the lining "L" covers the first and second portions 44, 46 of the pulp chamber surfaces "PCS". The lining "L", consisting of the first and second insert elements 38, 40, is subjected to wear by the slurry directed through the pulp chamber 22. As noted above, the fasteners 42 secure the first and second insert elements 38, 40 in the pulp chamber 22.

Preferably, the first insert element 38 is secured to the interior wall 32 by the fasteners 42, and the second insert element 40 is secured to the interior wall 30 by the fasteners 42. Those skilled in the art would appreciate that, alternatively, the first insert element 38 may be secured to the interior wall 30, and the insert element 40 may be secured to the other interior wall 32.

Figure 2A:
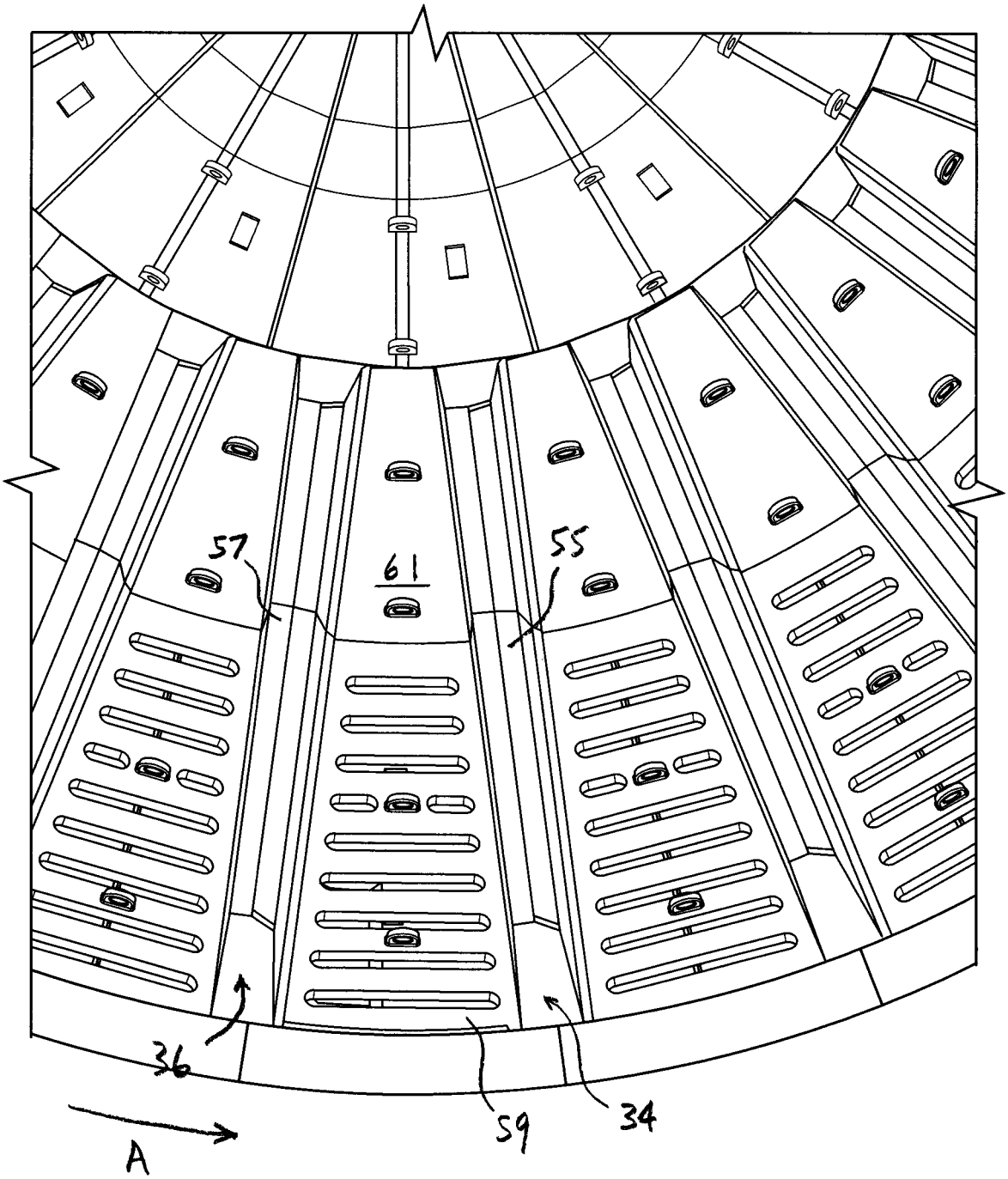
FIG. 2A is an isometric view of a portion of the discharge end wall of FIG. 1C including an embodiment of the split pulp chamber insert assembly of the invention located between a leading pulp lifter and a trailing pulp lifter, drawn at a smaller scale.
Figure 2B:
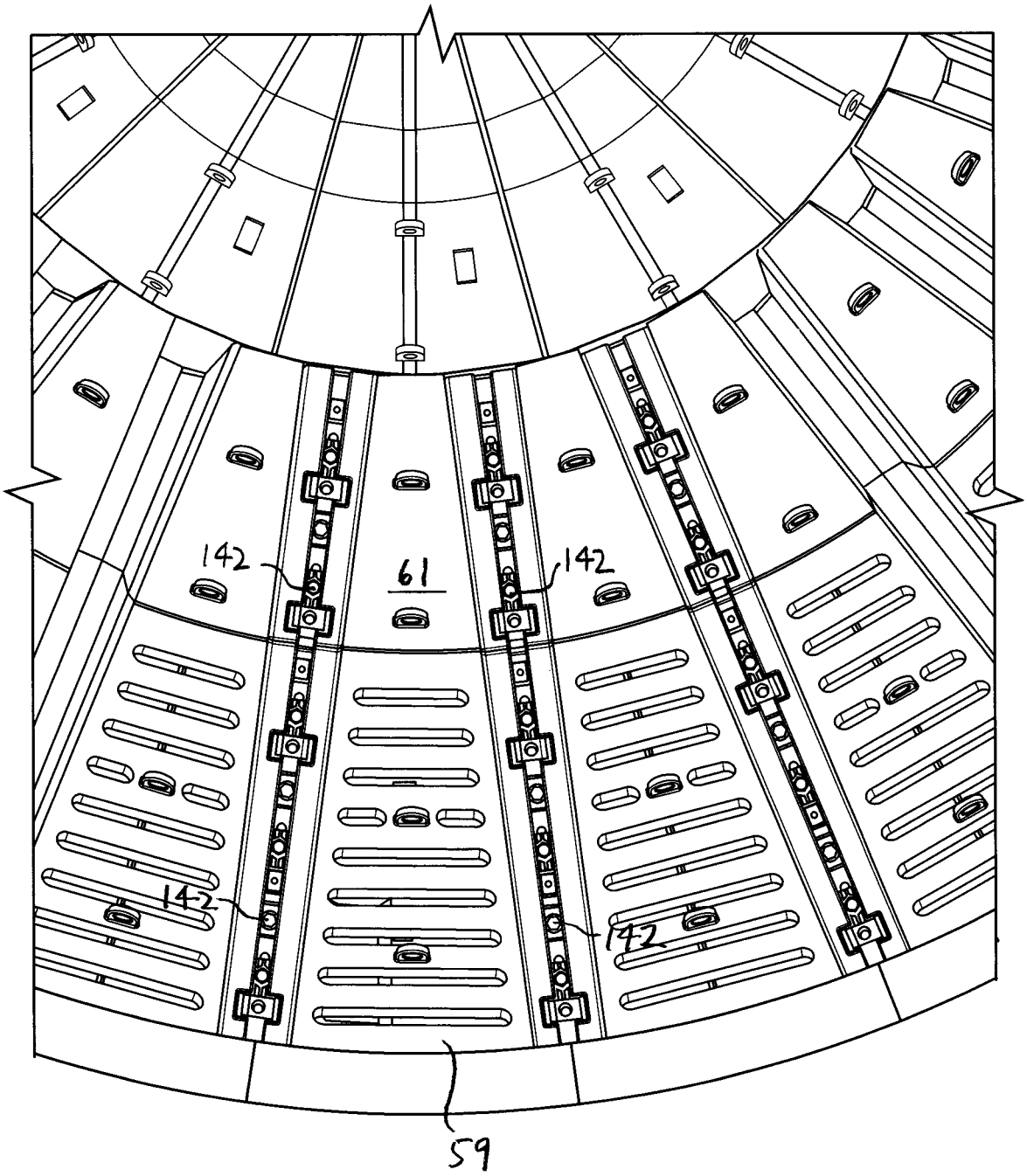
FIG. 2B is an isometric view of the portion of the discharge end wall of FIG. 2A with exterior portions of the leading and trailing pulp lifters removed.

As can be seen in FIG. 2A, each pair of pulp lifters (i.e., each pair thereof partially defining a pulp chamber therebetween) includes a leading and a trailing pulp lifter relative to the direction of rotation. For convenience, for the pulp chamber 22, the leading pulp lifter is identified in FIG. 2A by reference numeral 34, and the trailing pulp lifter is identified by reference numeral 36.

The leading pulp lifter 34 includes the trailing interior wall 30, and the trailing pulp lifter 36 includes the leading interior wall 32. It will be understood that the trailing and leading interior walls 30, 32 are identified as such relative to the direction of rotation. As noted above, the pulp chamber surfaces "PCS" include respective surfaces "$IWS_1$", "$IWS_2$" of the trailing interior wall 30 and the leading interior wall 32, the floor surface 48 between the trailing and leading interior walls 30, 32, and the outer wall surface 50, which is located distal to the discharge opening 29.

As can be seen in FIG. 2A, the leading pulp lifter 34 and the trailing pulp lifter 36 preferably include respective exterior portions 55, 57 thereof. A discharge grate 59 and a blind plate 61 preferably are located between the exterior portions 55, 57, to partially define the pulp chamber 22. As can also be seen in FIG. 2A, the discharge grate 59 is located distal to the discharge opening 29, and the blind plate 61 is located between the discharge grate 59 and the discharge opening 29.

Figure 4A:
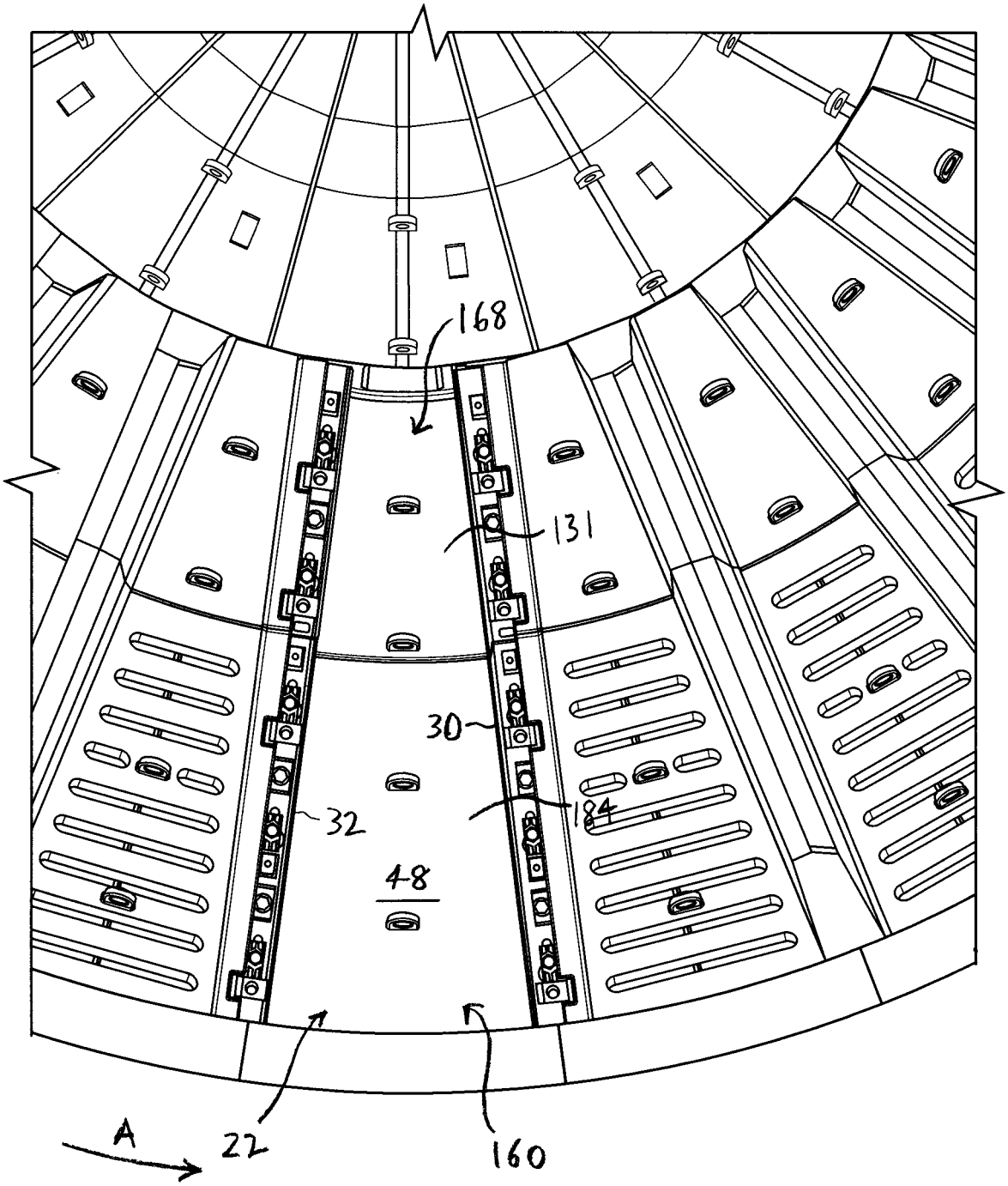
FIG. 4A is an isometric view of the pulp chamber of FIG. 2C in which a first outer portion and a first inner portion of pulp chamber surfaces partially defining the pulp chamber of FIG. 2C are shown.
Figure 4B:
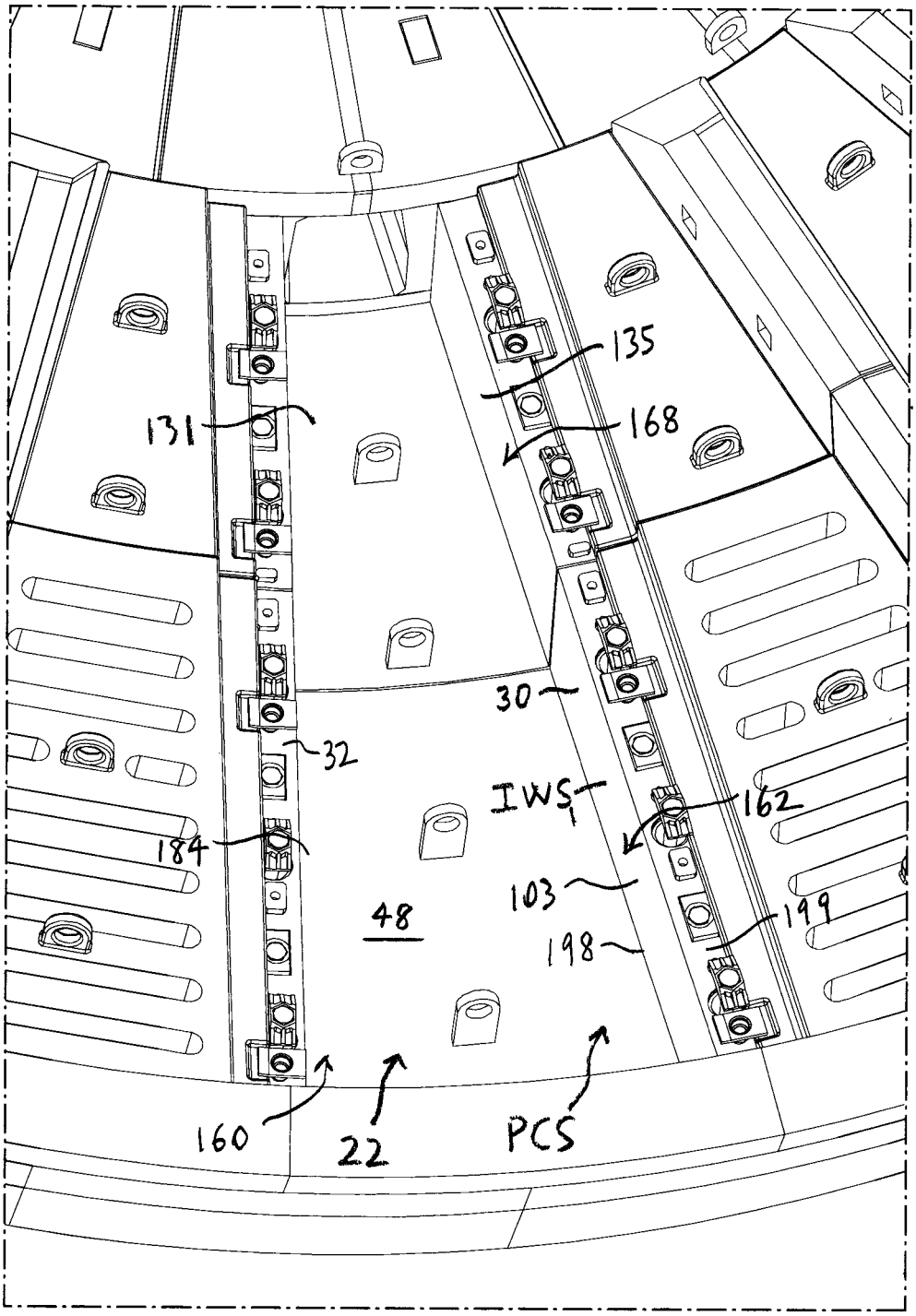
FIG. 4B is an isometric view of the pulp chamber of FIG. 4A in which a trailing interior wall surface of the pulp chamber surfaces is shown.
Figure 4C:
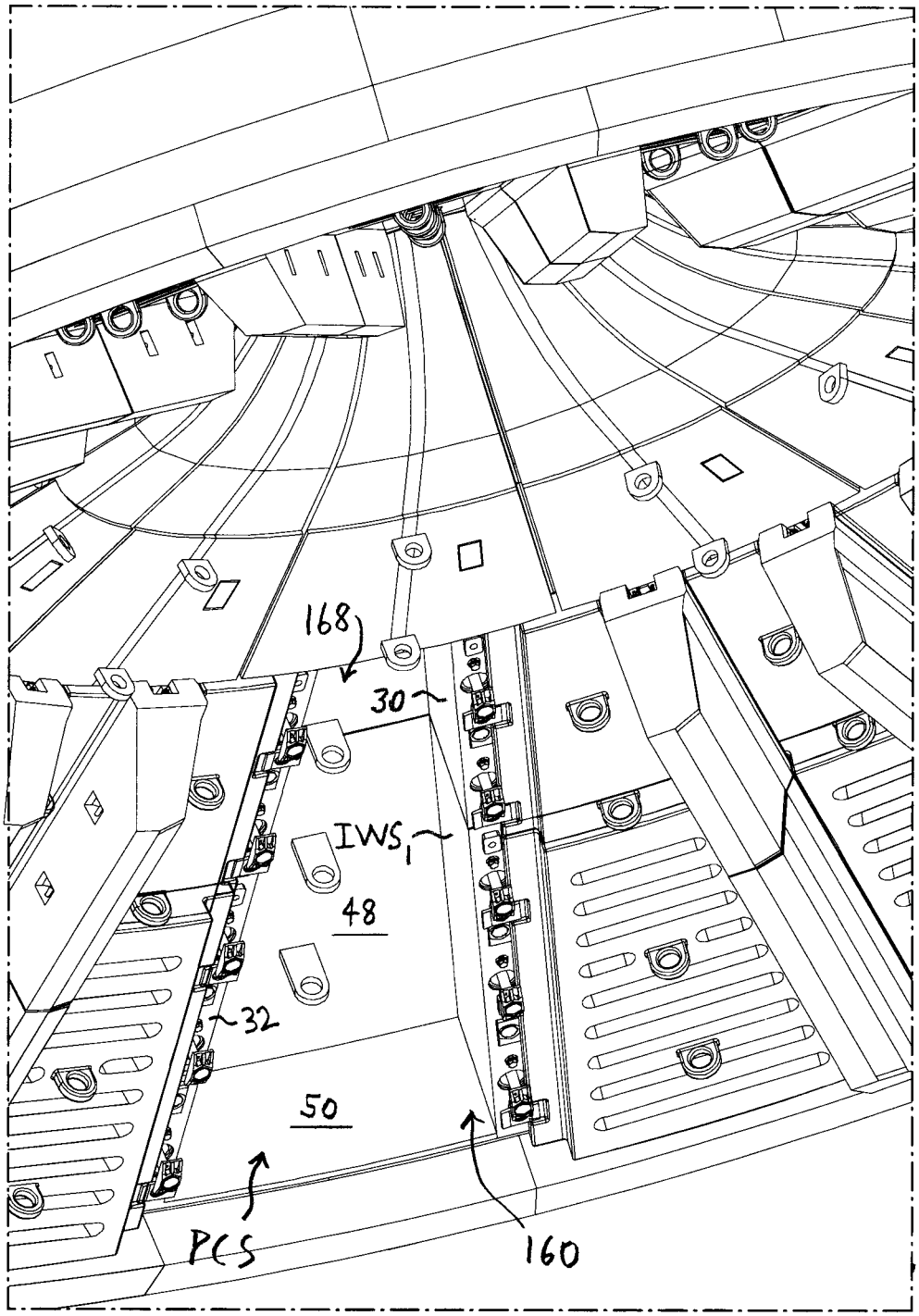
FIG. 4C is an isometric view of the pulp chamber of FIG. 4A in which the trailing interior wall surface and an outer wall surface of the pulp chamber surfaces are shown.
Figure 4D:
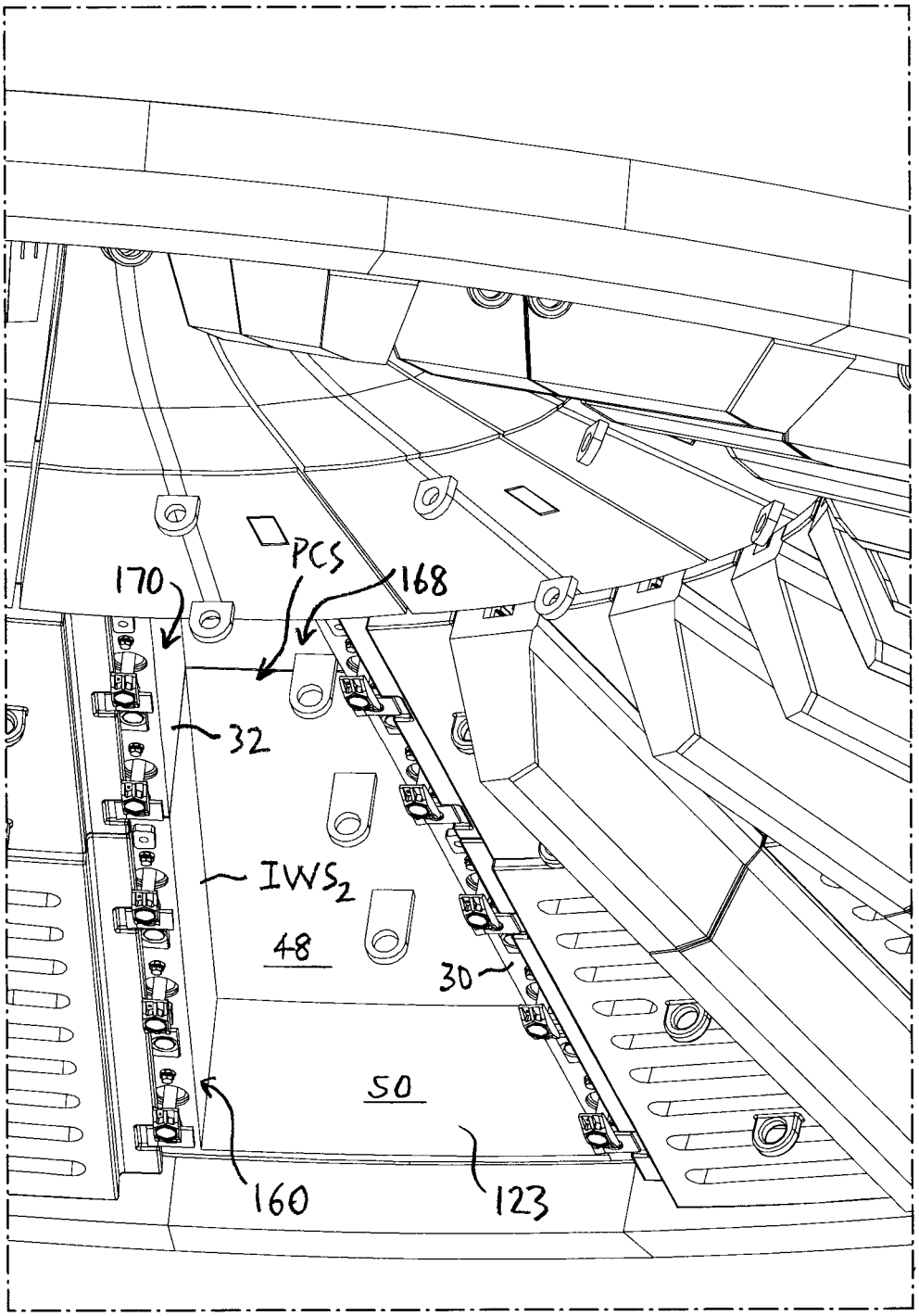
FIG. 4D is an isometric view of the pulp chamber of FIG. 4A in which a leading interior wall surface and an outer wall surface of the pulp chamber surfaces are shown.
Figure 4E:
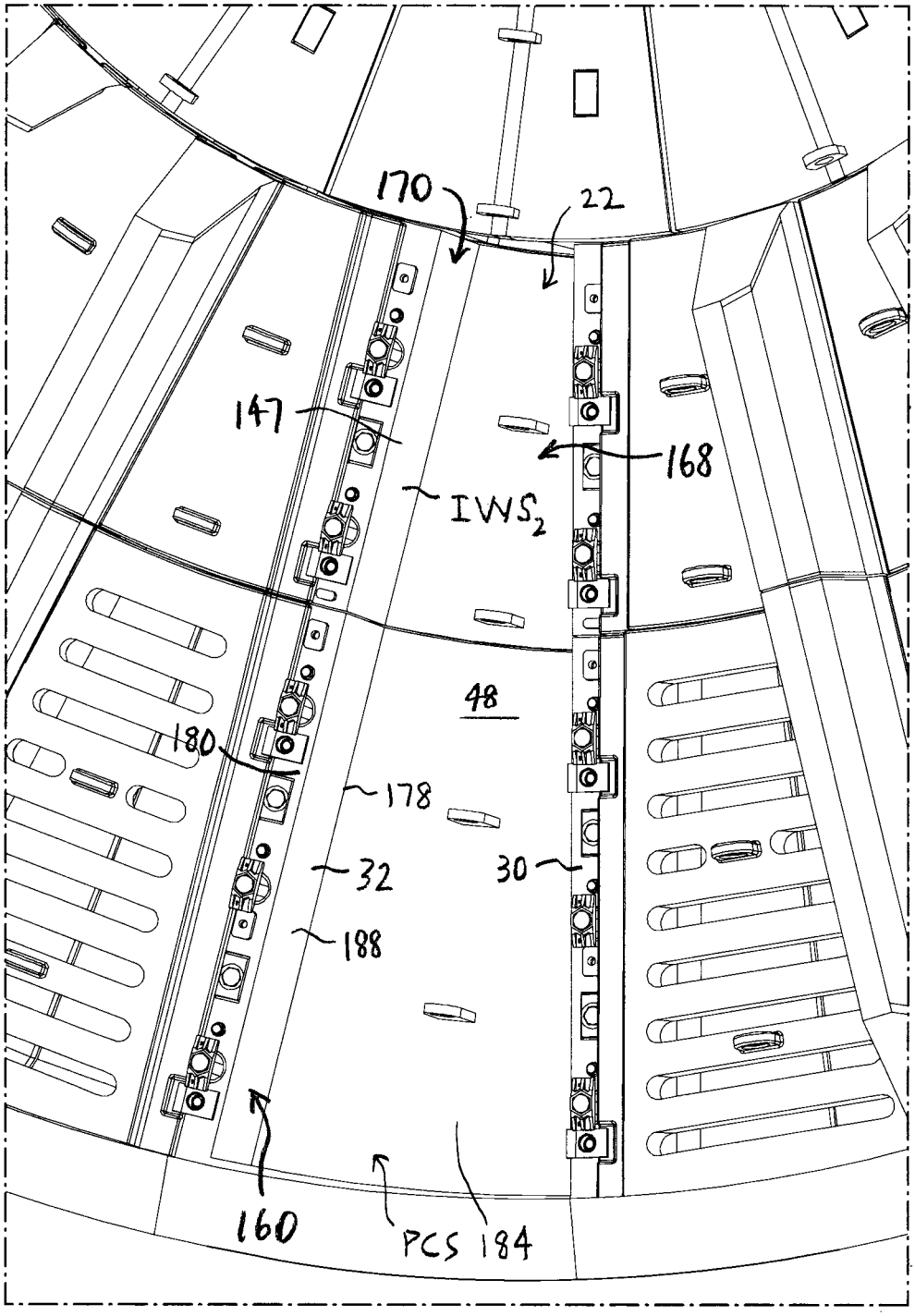
FIG. 4E is an isometric view of the pulp chamber of FIG. 4A in which the leading interior wall surface is shown.

As can be seen in FIGS. 2A and 4E, the interior wall 32 of the trailing pulp lifter 36 is the leading interior wall, relative to the pulp chamber 22 that the interior wall 32 partially defines, and in relation to the direction of rotation. Similarly, and as can be seen in FIGS. 2A and 4B, the interior wall 30 of the leading pulp lifter 34 is the trailing interior wall, relative to the pulp chamber 22, and in relation to the direction of rotation.

Another embodiment of the split pulp chamber insert assembly 120 is illustrated in FIGS. 2A-9C. In one embodiment, the split pulp chamber insert assembly 120 preferably includes an outer insert subassembly 152, and an inner insert subassembly 154, each of which is formed for installation in the pulp chamber 22 (FIG. 2C). In FIGS. 2B and 2C, the exterior portions 55, 57 of the leading and the trailing pulp lifters 34, 36 are omitted, for clarity of illustration. It will be understood that the discharge grate 59 and the blind plate 61 are also omitted from FIG. 2C, so that the pulp insert assembly 120, installed in the pulp chamber 22, can be seen in FIG. 2C.

Figure 2C:
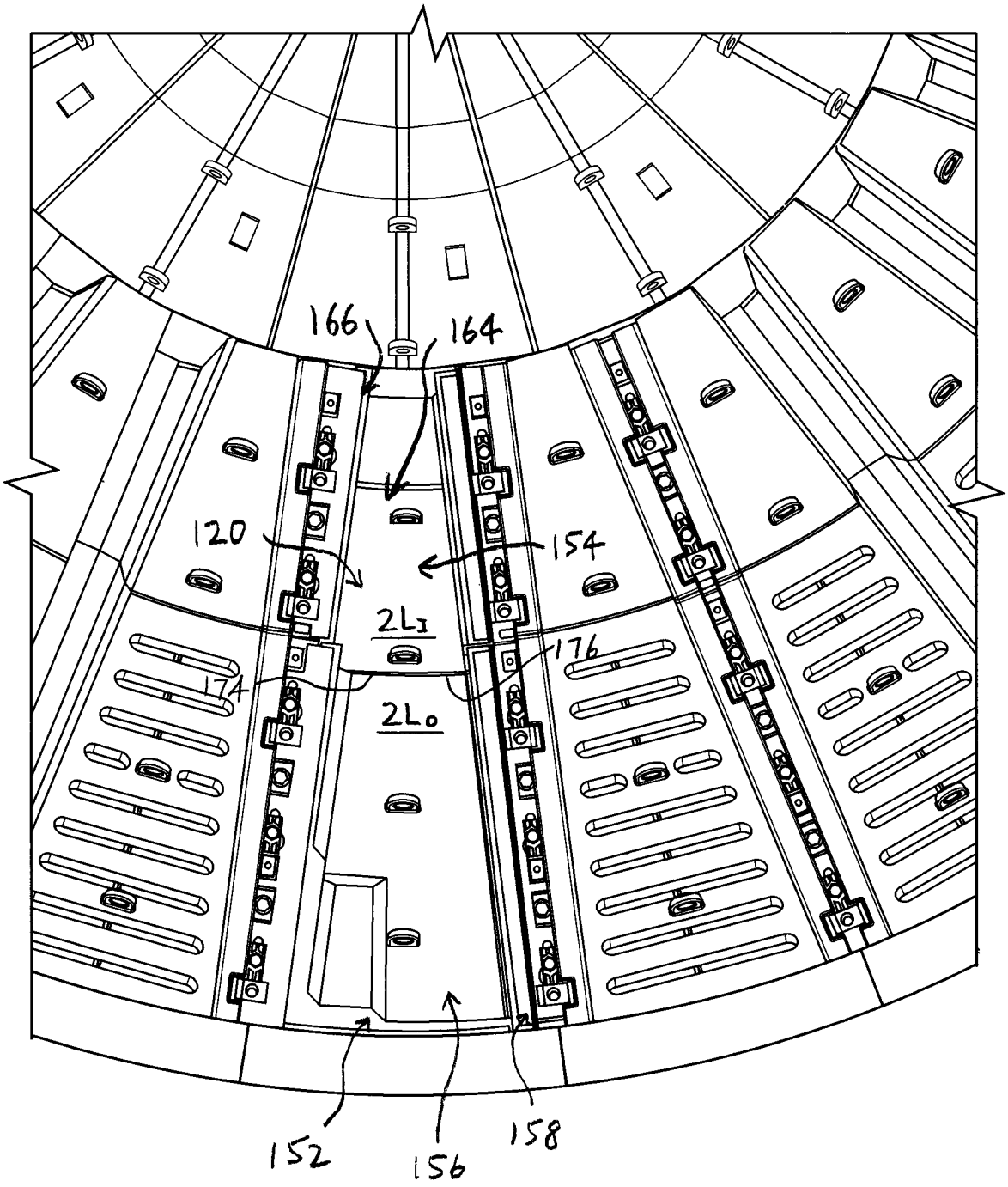
FIG. 2C is an isometric view of the portion of the discharge end wall of FIG. 2A with a blind plate and a discharge grate removed, to show another embodiment of a split pulp chamber insert assembly of the invention installed in the pulp chamber.

It is preferred that the outer insert subassembly 152 is formed for installation thereof in the pulp chamber 22 proximal to the outer wall surface 50, i.e., distal to the opening 29 (FIG. 2C). In one embodiment, the outer insert subassembly 152 preferably includes first and second outer insert elements 156, 158. Those skilled in the art would appreciate that the outer insert subassembly 152 may, alternatively, include more than two outer insert elements.

As can be seen in FIGS. 3B, 4A-4E and 5A-5D, the first outer insert element 156 preferably is configured for location thereof on a preselected first outer portion 160 of the pulp chamber surfaces "PCS", to cover the first outer portion 160. Also, the second outer insert element 158 preferably is configured for location thereof on a preselected second outer portion 162 of the pulp chamber surfaces "PCS", to cover the second outer portion 162. Preferably, the outer insert subassembly 152 includes a number of fasteners 142 (FIG. 2C), for securing the first and second outer insert elements 156, 158 in the pulp chamber 22.

As can be seen in FIG. 2C, in one embodiment, the first outer insert element 156 preferably is secured to the interior wall 32 by the fasteners 142, and the second outer insert element 158 preferably is secured to the interior wall 30 by the fasteners 142. It will be understood that, alternatively, the first outer insert element 156 may be secured to the interior wall 30, and the second outer insert element 158 may be secured to the interior wall 32.

In one embodiment, the first and second outer insert elements 156, 158 preferably are formed to cooperate with each other when installed in the pulp chamber 22, to provide an outer lining "$2L_O$" (FIG. 2C) in the pulp chamber 22 that covers the first and second outer portions 160, 162 of the pulp chamber surfaces "PCS". Accordingly, once the first and second outer insert elements 156, 158 are installed in the pulp chamber 22, the first and second outer insert elements 156, 158, are subjected to wear by the slurry that is directed through the pulp chamber 22.

It is also preferred that the inner insert subassembly 154 is configured for location thereof in the pulp chamber 22 between the outer insert subassembly 152 and the discharge opening 29. The inner insert subassembly 154 preferably includes a first inner insert element 164 and a second inner insert element 166. Those skilled in the art would appreciate that the inner insert subassembly 154 may, alternatively, include more than two inner insert elements.

The first inner insert element 164 preferably is configured for location thereof on a preselected first inner portion 168 of the pulp chamber surfaces "PCS", to cover the first inner portion 168. The second inner insert element 166 is for location thereof on a preselected second inner portion 170 of the pulp chamber surfaces "PCS", to cover the second inner portion 170. The inner insert subassembly 154 preferably also includes a number of the fasteners 142, for securing the first and second inner insert elements 156, 158 in the pulp chamber 22, between the outer insert subassembly 152 and the discharge opening 29.

As can be seen in FIG. 2C, in one embodiment, the first inner insert element 164 preferably is secured to the interior wall 30 by the fasteners 142, and the second inner insert element 166 preferably is secured to the interior wall 32 by the fasteners 142. It will be understood that, alternatively, the first inner insert element 164 may be secured to the interior wall 32, and the second inner insert element 166 may be secured to the interior wall 30.

In one embodiment, the first and second inner insert elements 164, 166 preferably are formed to cooperate with each other when installed in the pulp chamber 22, to provide an inner lining "$2L_I$" (FIG. 2C) in the pulp chamber 22 that covers the first and second inner portions 168, 170 of the pulp chamber surfaces "PCS". Accordingly, once the first and second inner insert elements 164, 166 are installed in the pulp chamber 22, the first and second inner insert elements 164, 166, are subjected to wear by the slurry that is directed through the pulp chamber 22.

Figure 3A:
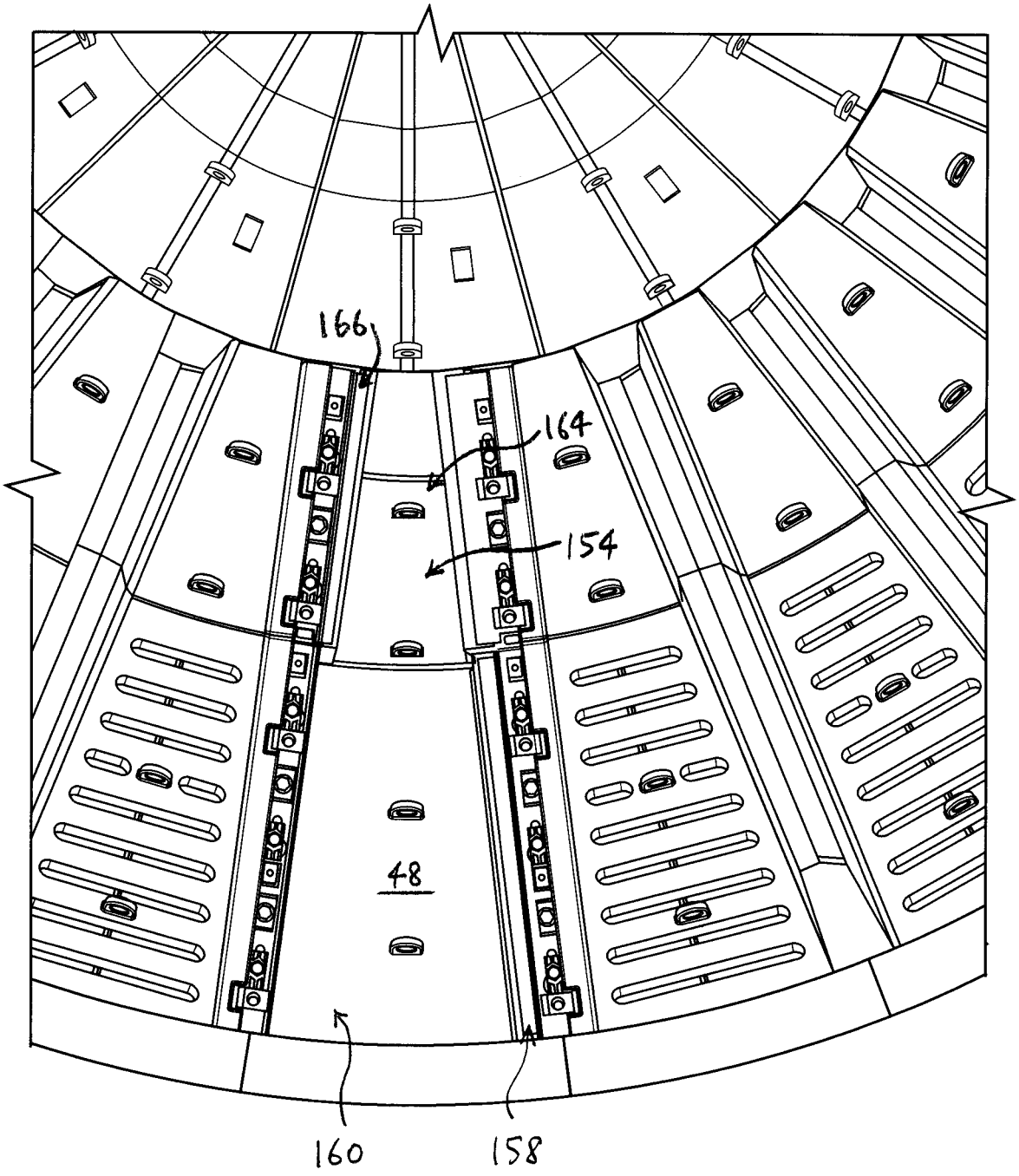
FIG. 3A is an isometric view in which a first outer insert element of an outer insert subassembly is removed, to disclose a portion of the floor surface of the pulp chamber of FIG. 2C.
Figure 3B:
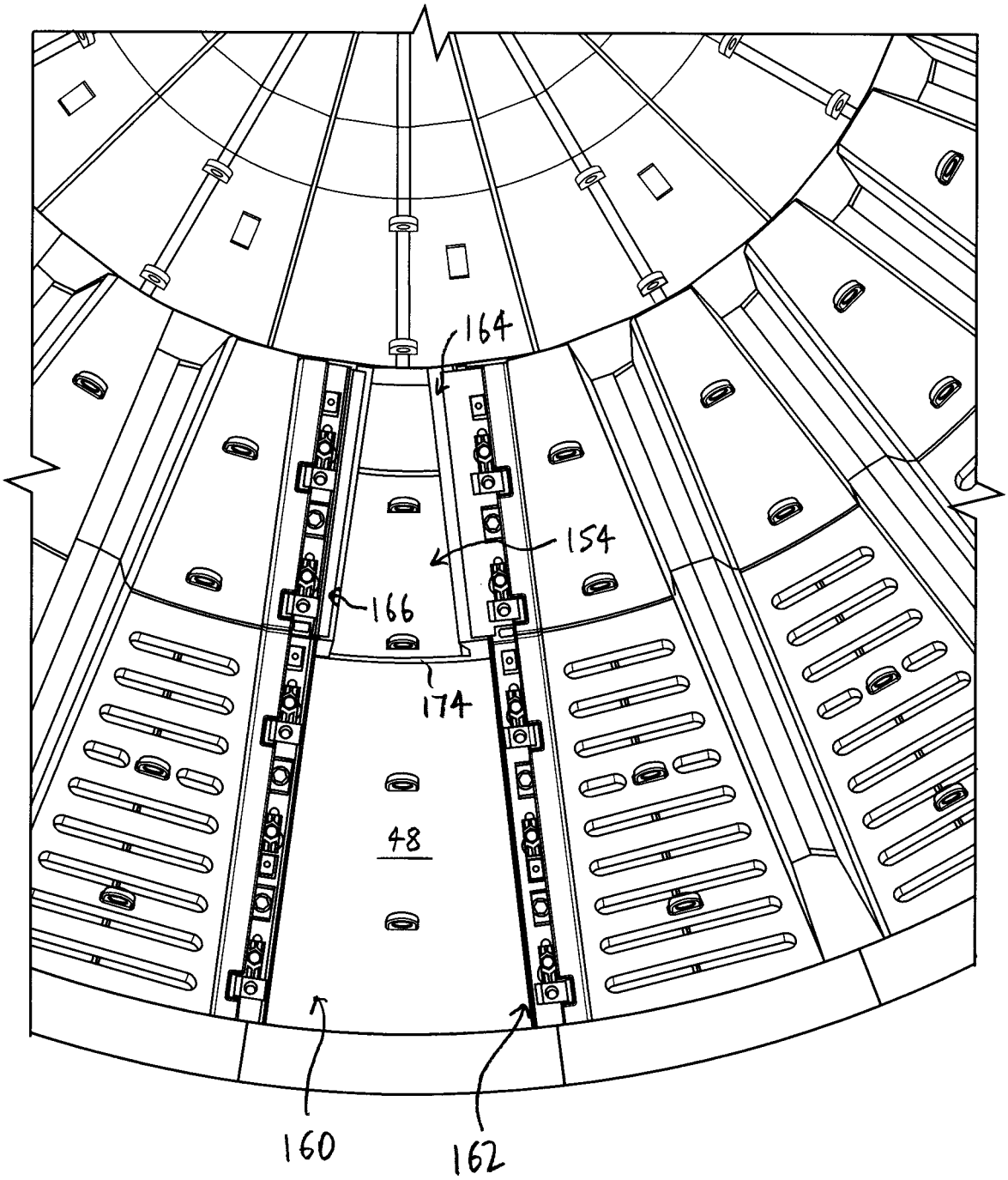
FIG. 3B is an isometric view in which a second outer insert element of the outer insert subassembly is removed, to disclose another portion of the floor surface of the pulp chamber of FIG. 2C.
Figure 3C:
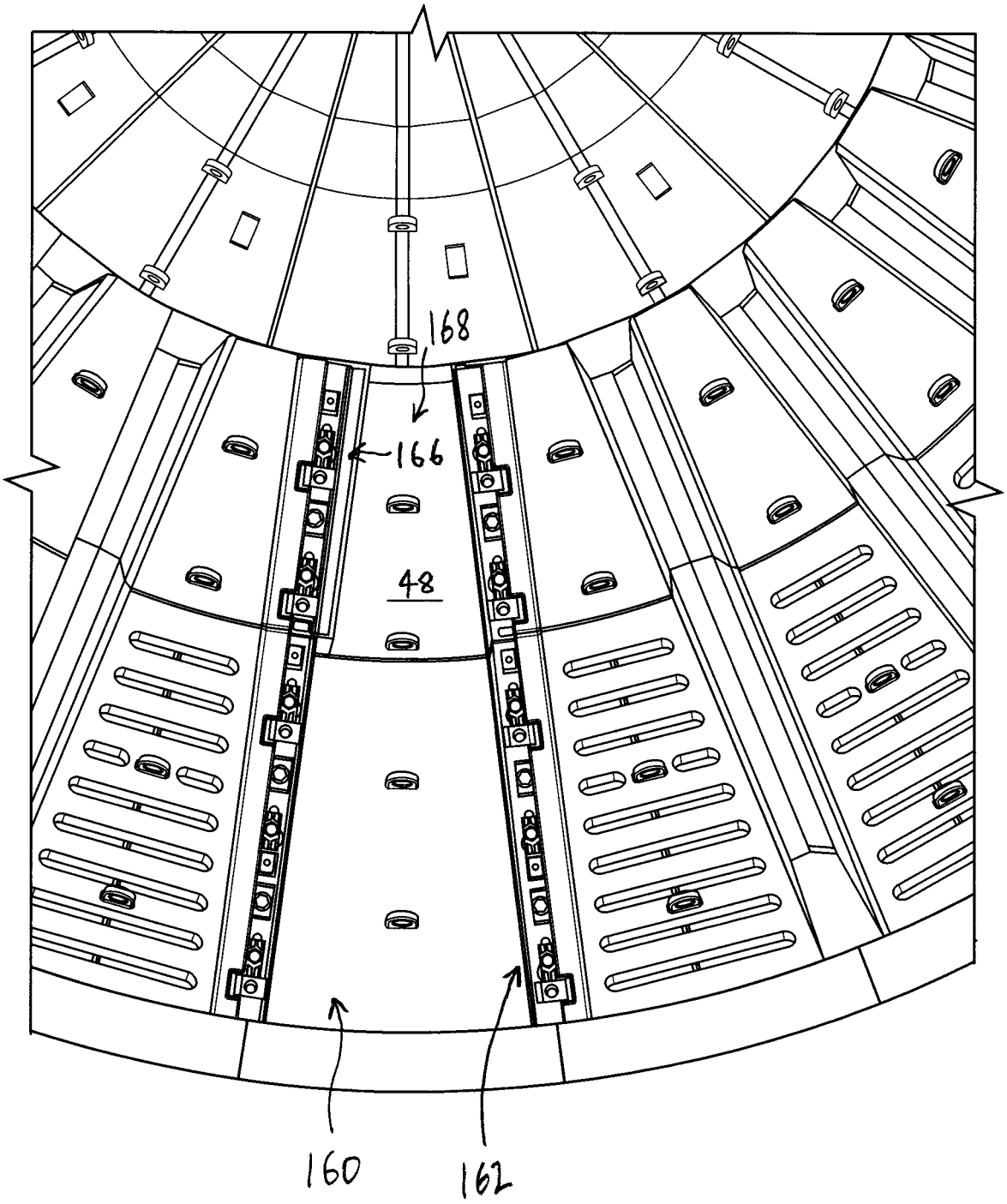
FIG. 3C is an isometric view in which a first inner insert element of an inner insert subassembly is removed, to disclose another portion of the floor surface of the pulp chamber of FIG. 2C.
Figure 3D:
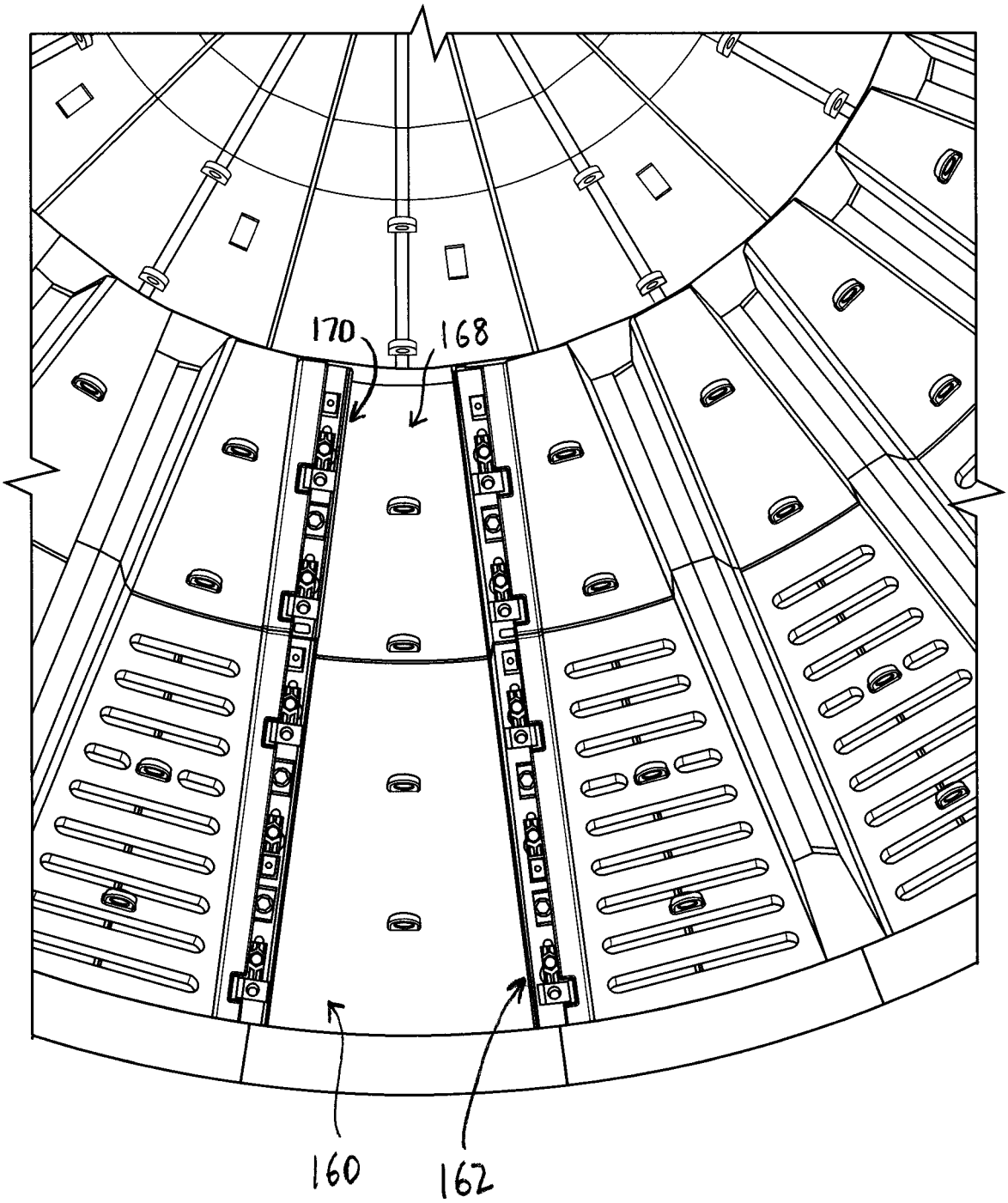
FIG. 3D is an isometric view of the pulp chamber in which a second inner insert element of the inner insert subassembly is removed, to disclose another portion of the floor surface of the pulp chamber of FIG. 2C.

As can be seen in FIG. 2C, it is also preferred that the outer and inner insert subassemblies 152, 154 are formed so that, when they are installed in the pulp chamber 22, the outer and inner linings "$2L_O$", "$2L_I$" formed thereby cooperate to form a substantially continuous lining surface along the length of the pulp chamber. In one embodiment, the outer lining "$2L_O$" preferably is partly defined by an inner edge 172 thereof (FIG. 2C), and the inner lining "$2L_I$" preferably is also partly defined by an outer edge 174 thereof (FIG. 3B). As can be seen in FIG. 2C, when the outer and inner insert subassemblies 152, 154 are installed in the pulp chamber 22, the outer edge 172 and the inner edge 174 preferably abut each other and are engaged with each other, to form a joint or seam 176 between the two linings "$2L_O$", "$2L_I$". Those skilled in the art would appreciate that the edges 172, 174 preferably engage each other along their respective lengths, so that the lining formed by the two linings "$2L_O$", "$2L_I$" in the pulp chamber 22 is substantially continuous.

In one embodiment, the leading interior wall 32 extends between an interior part 178 thereof adjacent to the floor surface 48 and an exterior part 180 thereof distal to the floor surface 48 (FIG. 4E). It is preferred that the first outer insert element 156 includes a first outer insert floor segment 182 (FIG. 5A), for covering a first outer area 184 of the floor surface 48. It is also preferred that the first outer insert element 156 includes a first outer insert wall segment 186 (FIG. 5A), for covering a first outer area 188 of the leading interior wall surface "$IWS_2$" (FIG. 4E). Preferably, and as can be seen in FIG. 5A, the first outer insert wall segment 186 extends between an internal side 190 thereof connected with the first outer insert floor segment 182 and an external side 192 thereof, located distal to the first outer insert floor segment 182.

As will be described, the first outer insert element 156 preferably also includes a first outer insert outer wall segment 121 (FIGS. 5A, 5B, 5D), for covering an area 123 (FIG. 4D) of the outer wall surface 50 when the first outer insert element 156 is installed in the pulp chamber 22.

For clarity, it will be understood that the first outer areas 184, 188 of the floor surface 48 and the leading interior wall surface "$IWS_2$" respectively, and the area 123 of the outer wall surface 50, are included in the first outer portion 160 of the pulp chamber surfaces "PCS".

Figure 5A:
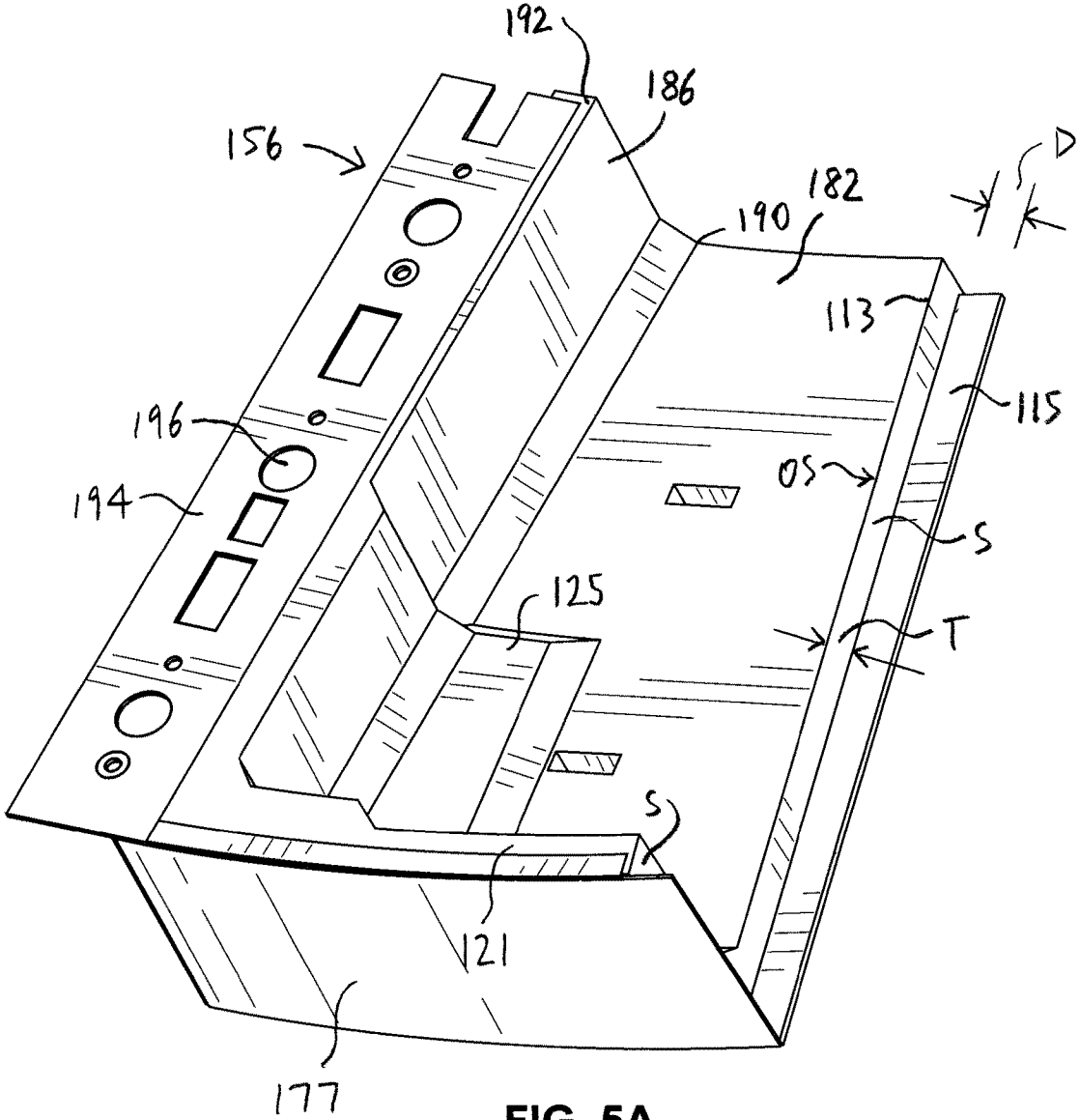
FIG. 5A is an isometric view of an embodiment of a first outer insert element of an outer insert subassembly of the split pulp chamber insert assembly, drawn at a larger scale.

Preferably, and as can be seen in FIG. 5A, the first outer insert element 156 also includes a first outer insert flange 194 secured to the external side 192 of the first outer insert wall segment 186. The flange 194 is formed for engaging the exterior part 180 of the leading interior wall 33, as will be described. It is also preferred that the first outer insert flange 194 includes apertures 196 therein, for receiving the fasteners 142 therein, to secure the first outer insert element 156 to the leading interior wall 32. Once the first outer insert flange 194 has been secured to the leading interior wall 32, the first outer insert element 156 is installed in the pulp chamber 22.

Figure 6A:
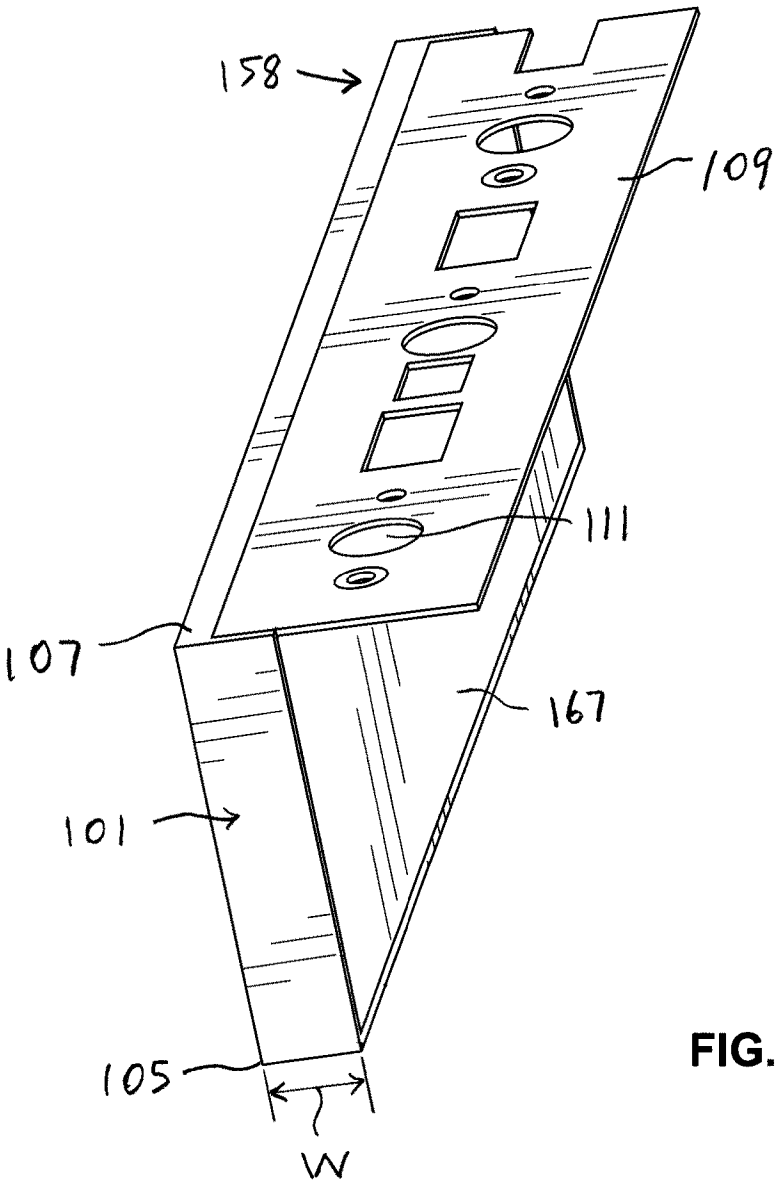
FIG. 6A is an isometric view of an embodiment of a second outer insert element of the outer insert subassembly, drawn at a larger scale.

As can be seen in FIG. 3B, the second outer insert element 158 preferably is secured to the trailing interior wall 30, to install the second outer insert element 158 in the pulp chamber 22. The trailing interior wall 30 extends between an interior part 198 thereof adjacent to the floor surface 48 and an exterior part 199 thereof distal to the floor surface 48 (FIG. 4B). As can be seen in FIG. 6A, it is preferred that the second outer insert element 158 includes a second outer insert wall segment 101, for covering a predetermined outer area 103 of the trailing interior wall surface "$IWS_1$" (FIG. 4B). Preferably, the second outer insert wall segment 101 extends between an internal side 105 thereof positionable proximal to the floor surface 48, and an external side 107 thereof, located distal to the internal side 105.

It will be understood that the second outer portion 162 of the pulp chamber surfaces "PCS" includes the outer area 103 of the trailing interior wall surface "$IWS_1$".

The second outer insert element 158 preferably also includes a second outer insert flange 109 secured to the external side 107, for engaging the exterior part 199 of the trailing interior wall 30. Preferably, the second outer insert flange 109 includes apertures 111 therein, for receiving the fasteners 142 to secure the second outer insert element 158 to the trailing interior wall 30.

As can be seen in FIGS. 5A, the first outer insert element 156 preferably is partially defined along an open side "OS" thereof by a lateral edge 113, formed to be spaced apart from the trailing interior wall 30 when the first outer insert element 156 is installed in the pulp chamber 22. The edge 113 extends along both the first outer insert floor segment 182 and the first outer insert outer wall segment 121. In one embodiment, the first outer insert floor segment 182 and the first outer insert outer wall segment 121 preferably also include a platform 115 that projects toward the trailing interior wall 30, when the first outer insert element 156 is installed in the pulp chamber 22. The open side of the first outer insert element 156 is also partially defined by the platform 115. As can be seen in FIG. 5A, it is preferred that the platform 115 extends beyond the lateral edge 113 by a distance "D".

In one embodiment, the first outer insert floor segment 182 and the first outer insert outer wall segment 121 are formed to cooperate with the second outer insert wall segment 101 to form the continuous lining "$2L_O$" over the first and second outer portions 160, 162 of the pulp chamber surfaces "PCS". As can be seen in FIG. 6A, it is preferred that the second outer insert wall segment 101 has a width "W" at its internal side 105 that is less than the distance "D". As will be described, the internal side 105 of the second outer wall segment 101 is formed to be received on the platform 115 once the first outer insert element 156 has been installed in the pulp chamber 22.

It is preferred that the first outer insert element 156 is installed in the pulp chamber 22 first, and the second outer insert element 158 is subsequently installed. Preferably, and as can be seen in FIG. 9B, when the first outer insert element 156 is installed in the pulp chamber 22, the platform 115 abuts, or almost abuts, the trailing interior wall 30.

From the foregoing, it can be seen that the platform 115 is formed to receive the internal side 105 of the second outer insert wall segment 101 thereon. When the second outer insert element 158 is installed in the pulp chamber 22, the internal side 105 of the second outer insert wall segment 101 is positioned on the platform 115 (FIG. 9B).

Figure 6B:
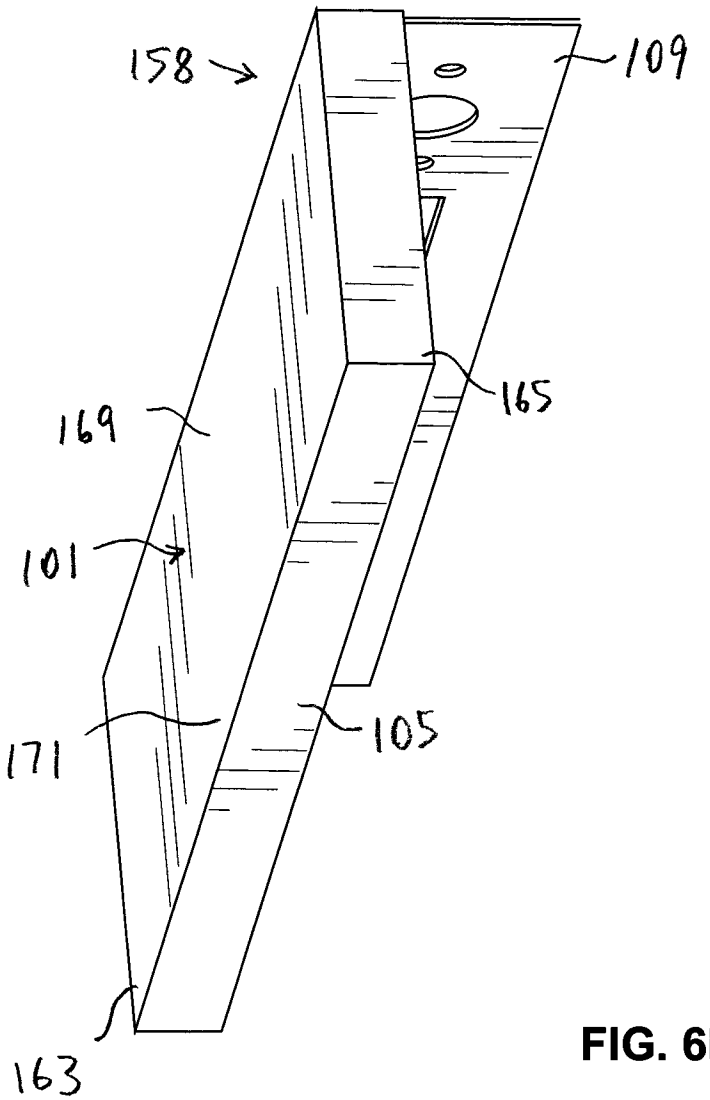
FIG. 6B is another isometric view of the second outer insert element of FIG. 6A.

As can be seen in FIG. 6B, the second outer insert wall segment 101 preferably extends between inner and outer ends 163, 165. The outer end 165 preferably has the same thickness or width "W" as the internal side 105. The outer end 165 is receivable on a portion of the platform 115 that is included in the first outer insert outer wall segment 121.

Figure 9A:
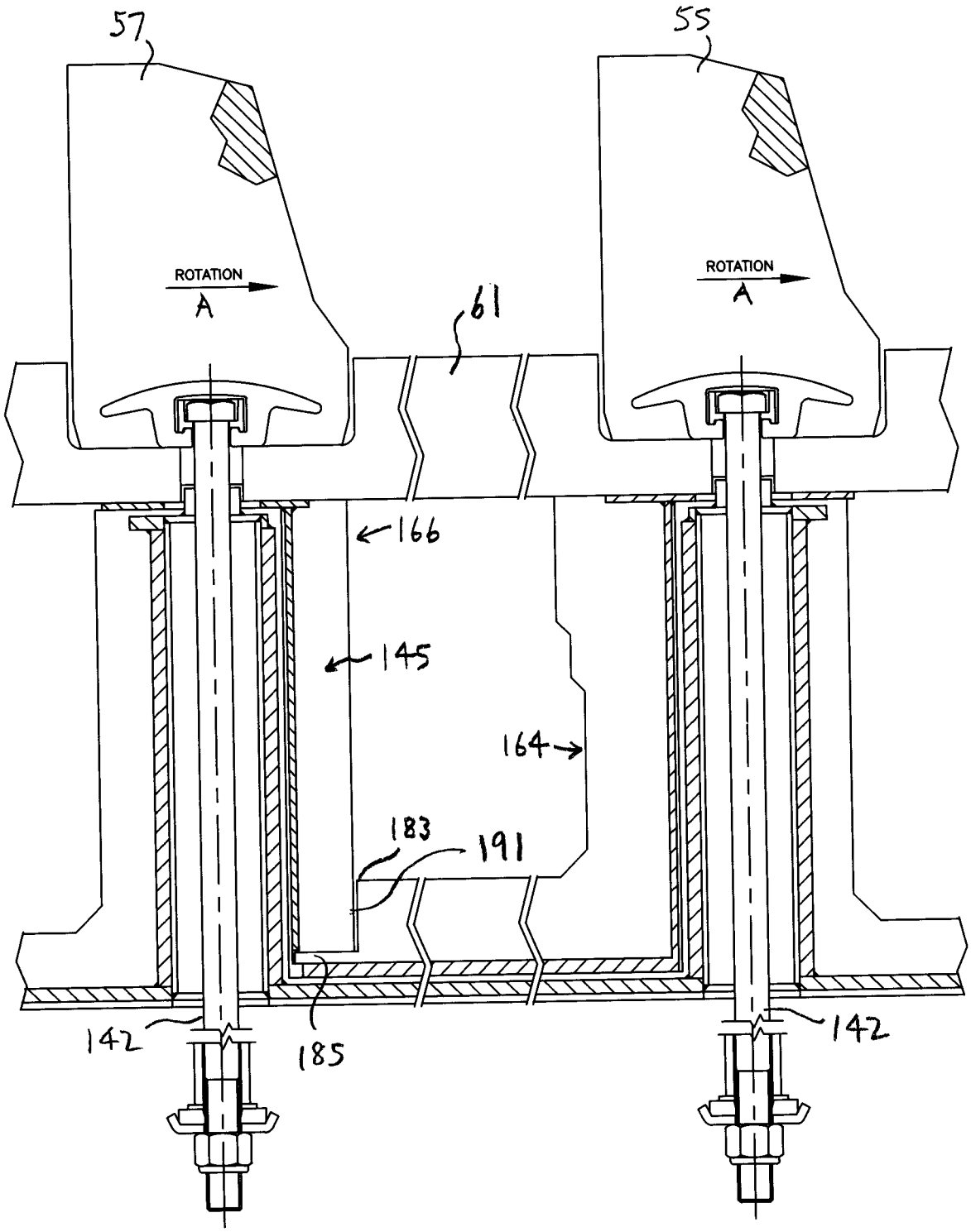
FIG. 9A is a cross-section of the inner insert subassembly of FIG. 2C as installed in the pulp chamber, taken along line E-E in FIG. 1C, drawn at a larger scale.
Figure 9B:
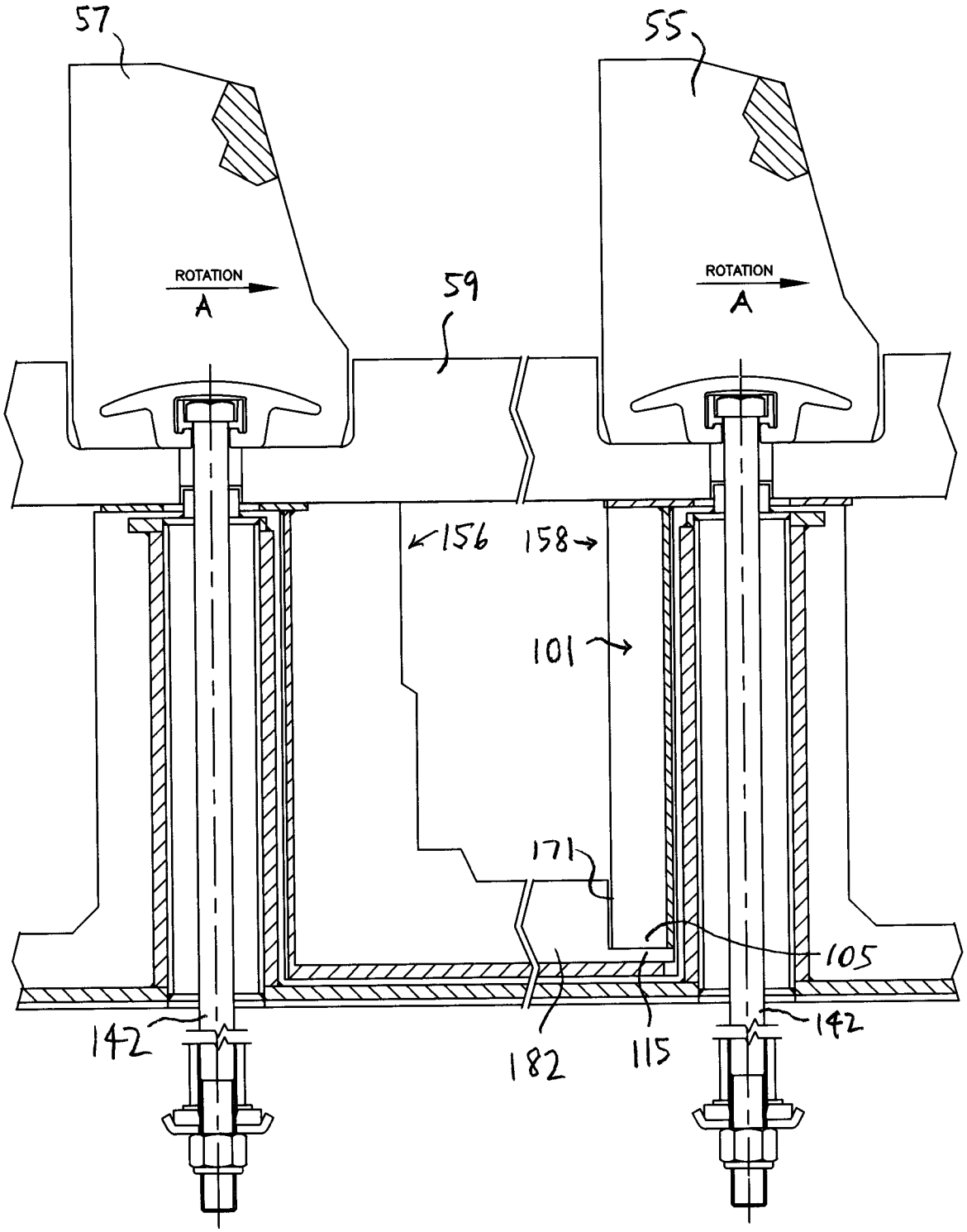
FIG. 9B is a cross-section of the outer insert subassembly of FIG. 2C as installed in the pulp chamber, taken along line F-F in FIG. 1C.

In this embodiment, the first and second outer insert elements 156, 158 cooperate to form the lining "$2L_O$" by fitting together, as can be seen in FIG. 9B, so that the first and second outer portions 160, 162 of the pulp chamber surfaces "PCS" are covered by the installed first and second outer insert elements 156, 158.

As can be seen in FIGS. 6A and 6B, the second outer insert wall segment 101 preferably has opposed interior and exterior sides 167, 169. When the second outer insert element 158 is installed in the pulp chamber 22, the interior side 167 preferably engages the outer area 103 of the trailing interior wall surface "$IWS_2$", covering the area 103. Also, when the second outer insert element 158 is installed in the pulp chamber 22, part of the exterior side 169 preferably engages the first outer insert floor segment 182 and the outer wall segment 121 along the edge 113 of the open side "OS".

Figure 5B:
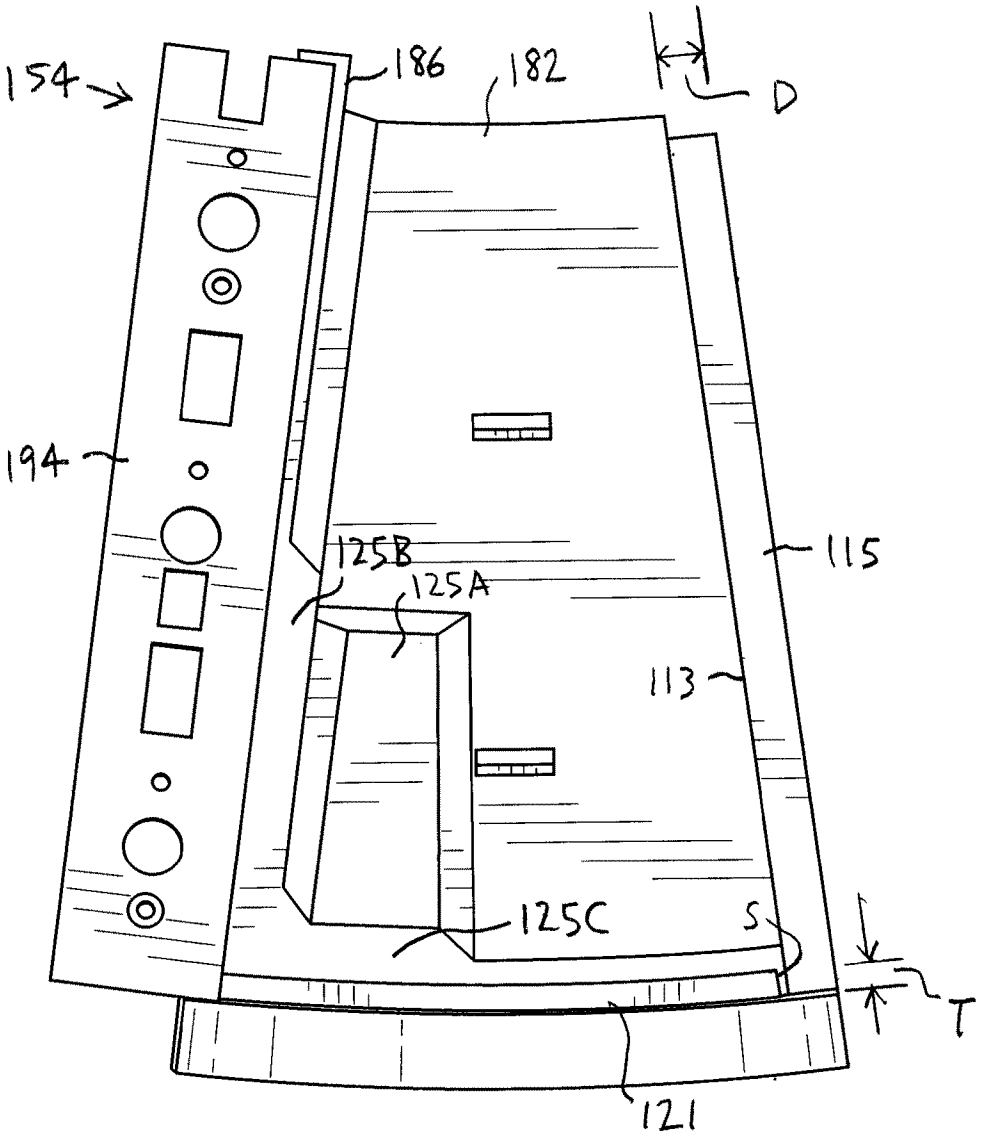
FIG. 5B is another isometric view of the first outer insert subassembly of FIG. 5A.

As can be seen in FIG. 5A, along the edge 113, the first outer insert floor segment 182 preferably has a thickness "T" above the platform 115, defining a surface "S". Preferably, the first outer insert outer wall segment 121 also has the same thickness "T", and the surface "S" extends along the first outer insert outer wall segment 121 (FIG. 5B). It will be understood that, when the internal side 105 is positioned on the platform 115, a portion 171 (FIG. 6B) of the exterior side 169 of the second outer insert wall segment 101 engages the surface "S" (FIG. 9B). The balance of the exterior side 169, which is not engaged with the surface "S", forms part of the lining "$2L_O$", and is subjected to wear by the slurry.

Those skilled in the art would appreciate that the internal side 105 fits into a slot between the surface "S" and the trailing interior wall 30. As noted above, the width "W" of the second outer insert wall segment 101 at the internal side 105 thereof preferably is slightly less than the width "D" of the platform 115, so that the internal side 105 and outer end 165 fit onto the platform 115. However, those skilled in the art would appreciate that it is preferable that the portion 171 of the exterior side 169 fits tightly against the surface "S", to minimize the amount of fines from the slurry that will get into the lining, between the first outer insert element 156 and the second outer insert element 158 when they are installed in the pulp chamber 22. Accordingly, the width "W" of the second outer insert wall segment 101 preferably is only slightly narrower than the width "D" of the platform 115.

As noted above, in one embodiment, the first outer insert element 156 preferably includes the first outer insert outer wall segment 121, for covering the predetermined area 123 of the outer wall surface 50. Preferably, the first outer insert outer wall segment 121 is connected with the first outer insert floor segment 182 and the first outer insert wall segment 186 (FIGS. 5A-5D).

In one embodiment, either or both of the first outer insert element 156 and the second outer insert element 158 preferably also includes one or more reinforced regions 125 thereof. It will be understood that the reinforced regions 125 preferably are located in the areas of the elements 156, 158 that are expected to be subjected to greater wear by the slurry.

For instance, in one embodiment, the reinforced region 125 preferably is formed in the first outer insert floor segment 182 and is located proximal to the first outer insert outer wall segment 186. Alternatively, or in addition, the reinforced region 125 preferably is formed in the first outer insert wall segment 186 and is located proximal to the first outer insert outer wall segment 121.

In addition, or alternatively, the reinforced region 125 may be formed in the first outer insert outer wall segment 121 and located proximal to the first outer insert wall segment 186.

Figure 5C:
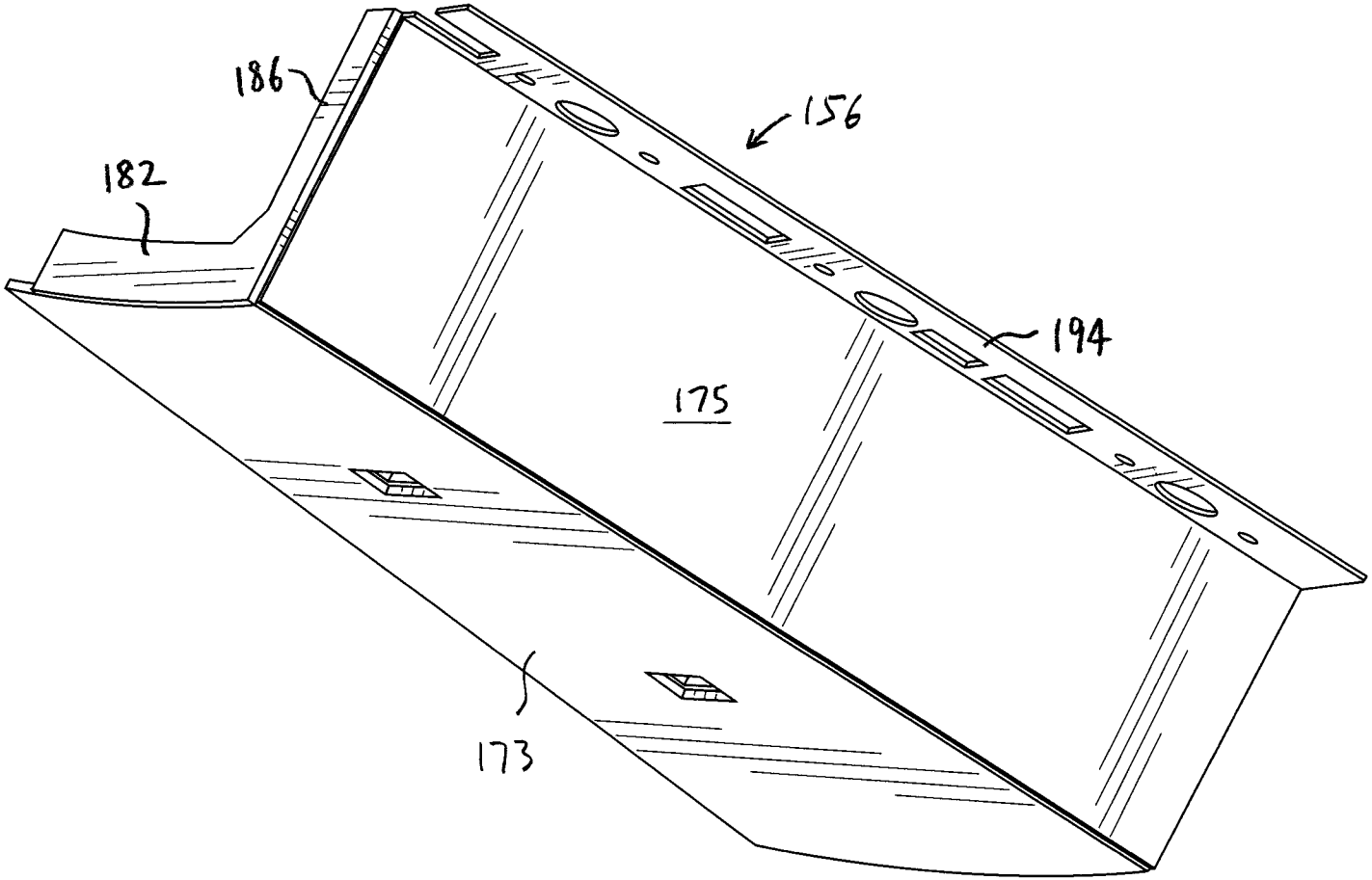
FIG. 5C is another isometric view of the first outer insert subassembly of FIG. 5A.
Figure 5D:
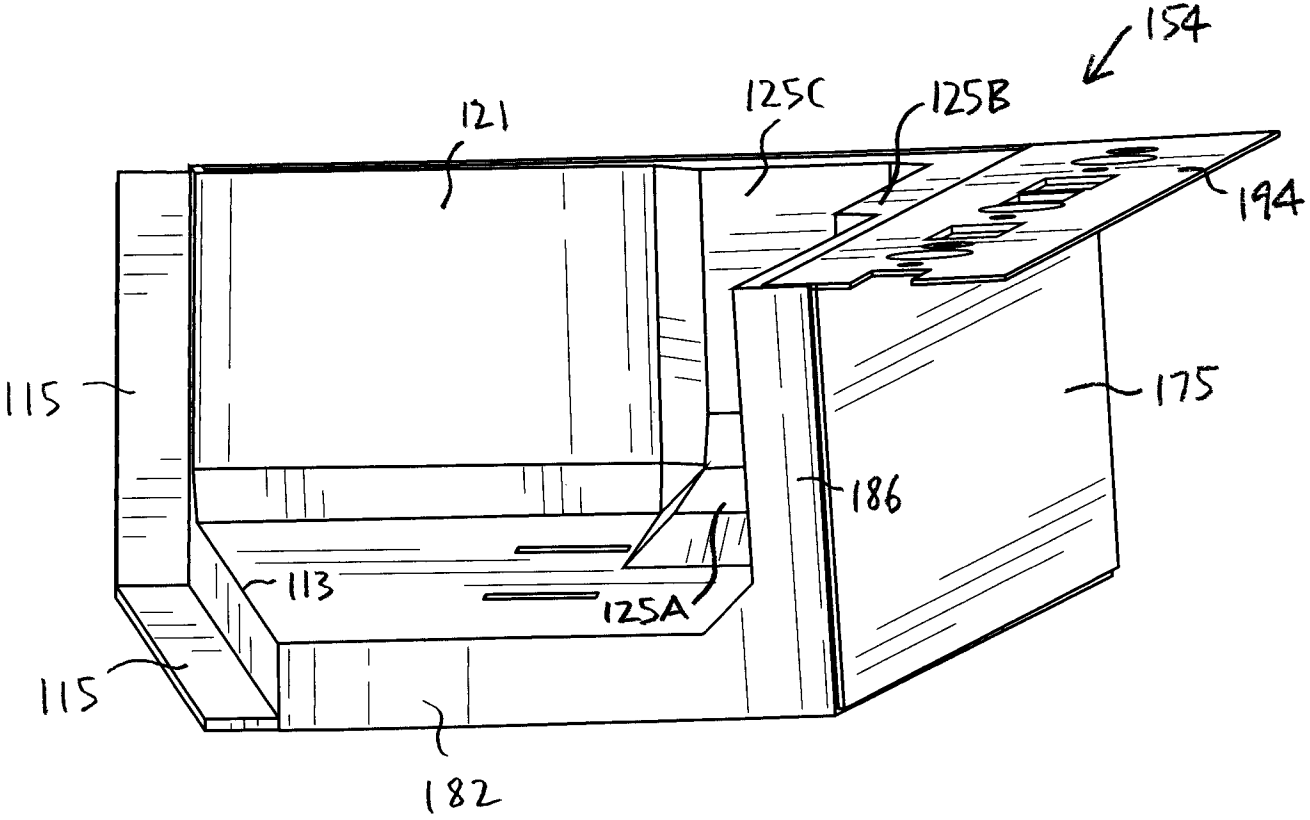
FIG. 5D is another isometric view of the first outer insert subassembly of FIG. 5A.

For convenience, the reinforced regions formed in the first outer insert floor segment 182, the first outer insert wall segment 186, and the first outer insert outer wall segment 121 are identified in FIGS. 5B and 5D by reference characters 125A, 125B, and 125C respectively.

Those skilled in the art would appreciate that the determination of locations on the insert element that are expected to be subjected to the most wear by the slurry may be based on data.

As can be seen in FIG. 5C, the first outer insert floor segment 182 preferably includes an engagement surface 173 formed for engagement with the floor surface 48, when the first outer insert element 156 is installed in the pulp chamber 22, to cover the first outer area 184 of the floor surface 48. Also, the first outer insert wall segment 186 preferably includes an engagement surface 175 for engagement with the leading exterior wall 32, to cover the first outer area 188 of the surface "$IWS_2$" thereof (FIG. 5C). The first outer insert outer wall segment 121 preferably includes an engagement surface 177 formed for engagement with the outer wall surface 50, to cover the area 123 of the outer wall surface 50 (FIG. 5A).

Figure 9C:
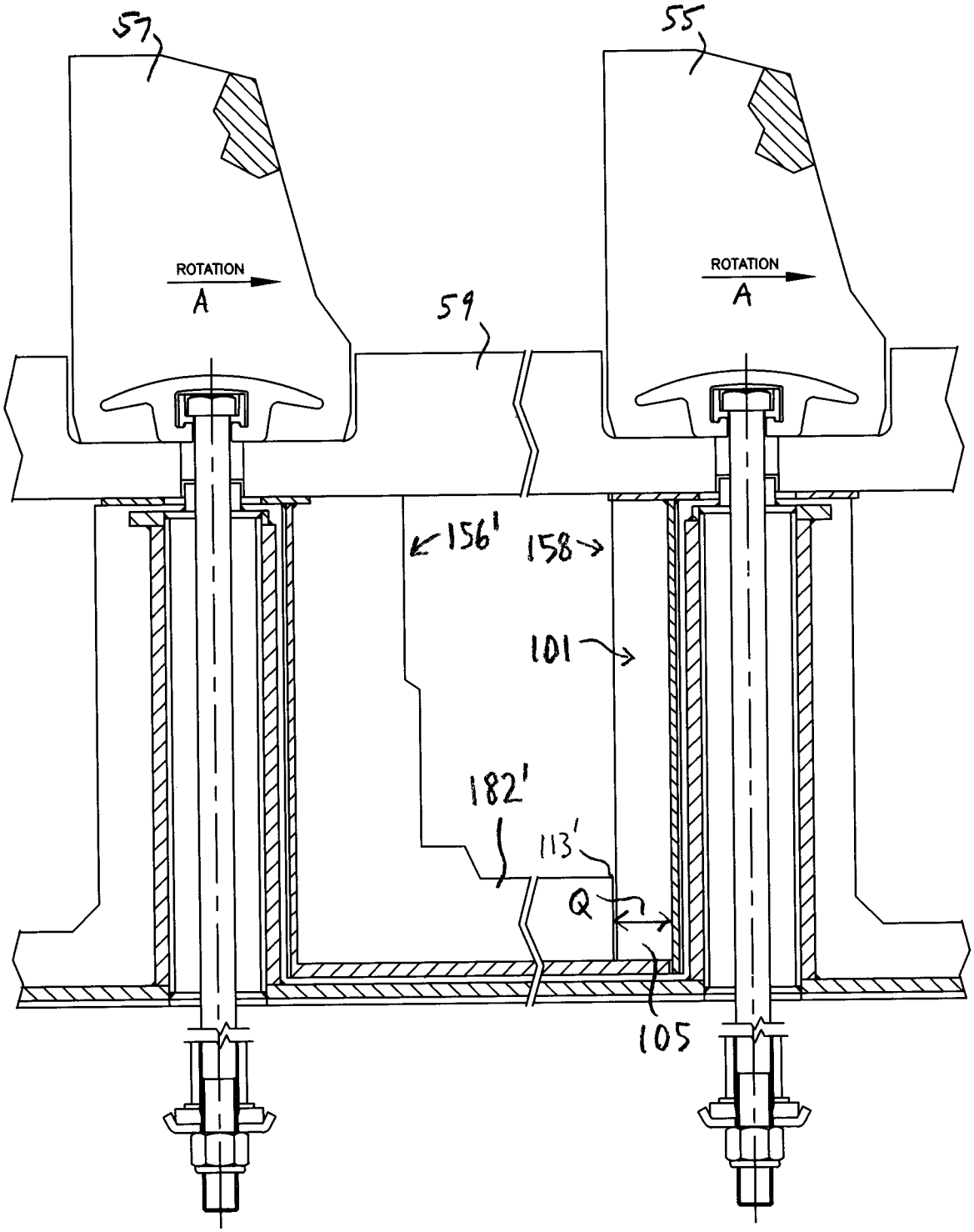
FIG. 9C is a cross-section of an alternative embodiment of the outer insert subassembly.

In another alternative embodiment, illustrated in FIG. 9C, the first outer insert element 156' does not include the platform 115 illustrated in FIG. 9B. Instead, and as can be seen in FIG. 9C, the first outer insert element 156' preferably includes a lateral edge 113' that is spaced apart from the trailing interior wall 30 when the first outer insert element 156' is secured in the pulp chamber 22, to define a slot "Q" between the edge 113' and the trailing interior wall 30 in which the internal side 105 of the second outer insert wall segment 101 is receivable. It will be understood that, in the embodiment illustrated in FIG. 9C, the second outer insert element 158 is as illustrated in FIGS. 6A and 6B. The first outer insert element 156' includes a first outer insert wall segment 182' and a first outer insert outer wall segment (not shown in FIG. 9C) that do not include the platform.

As noted above, and as illustrated in FIG. 2C, the split pulp chamber insert assembly 120 preferably includes the inner insert subassembly 154. In one embodiment, the first inner insert element 164 thereof preferably includes a first inner insert floor segment 127 (FIG. 7A), for covering a predetermined first inner floor area 131 of the floor surface 48 (FIGS. 4A, 4B). Preferably, the first inner insert element 164 also includes a first inner insert wall segment 133 (FIG. 7A), for covering a predetermined first inner wall area 135 of the trailing interior wall surface "$IWS_1$" (FIG. 4B). The first inner insert wall segment 133 preferably extends between an internal side 137 thereof connected with the first inner insert floor segment 127, and an external side 139 thereof, located distal to the internal side 137.

It will be understood that the first inner portion 168 of the pulp chamber surfaces "PCS" includes the first inner floor area 131 and the first inner wall area 135.

Figure 7A:
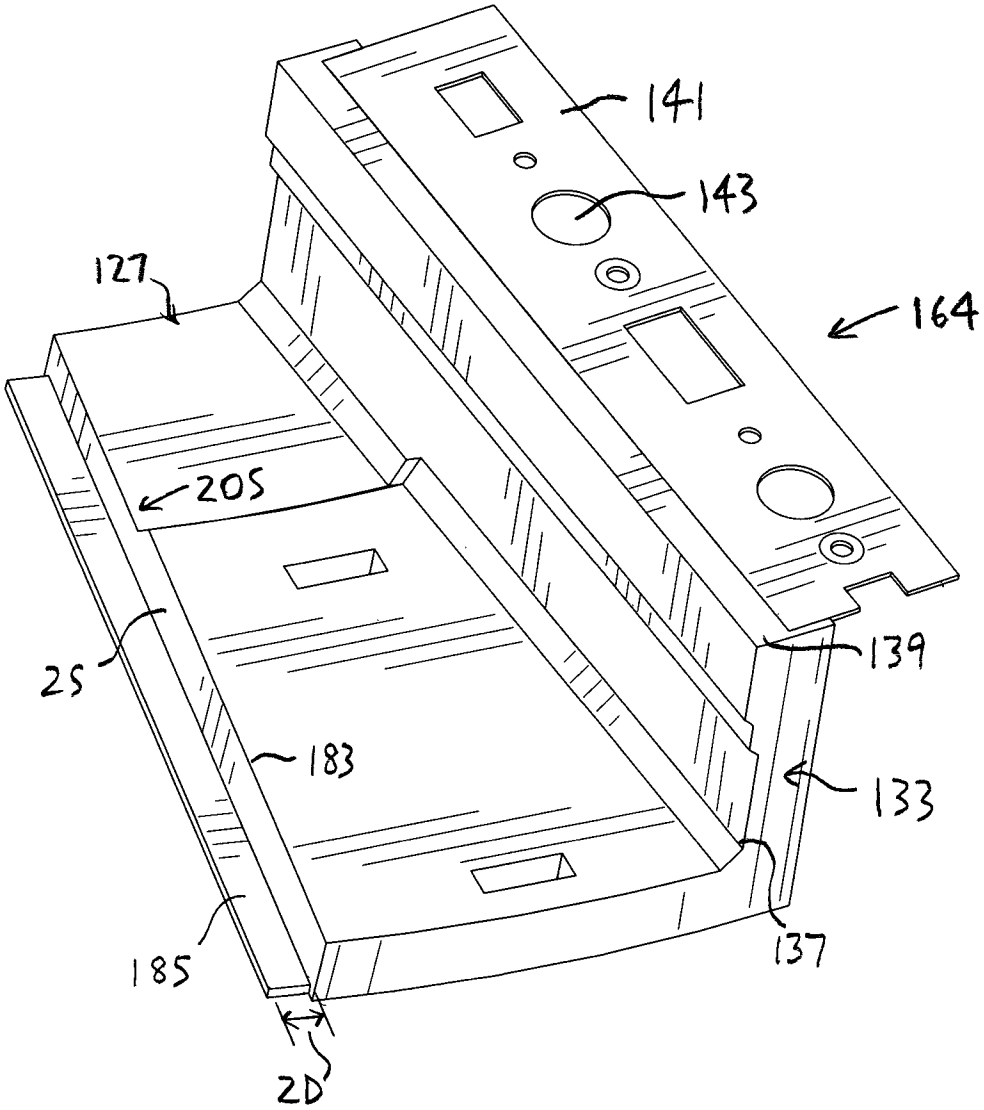
FIG. 7A is an isometric view of an embodiment of a first inner insert element of the invention.

As can be seen in FIG. 7A, it is also preferred that the first inner insert element 164 includes a first inner insert flange 141 secured to the external side 139, for engaging the exterior part 199 of the trailing interior wall 30. Preferably, the first inner insert flange 141 includes apertures 143 therein, for receiving the fasteners 142 to secure the first inner insert element 164 to the trailing interior wall 30.

Preferably, the first inner insert floor segment 127 includes an engagement surface 179 (FIG. 7B) that is formed for engagement with the floor surface 48, when the first inner insert element 164 is installed in the pulp chamber 22, to cover the first inner area 131 of the floor surface 48 (FIG. 4B). It is also preferred that the first inner insert wall segment 133 includes an engagement surface 181 (FIG. 7B) that is formed for engagement with the surface "$IWS_1$" of the interior wall 30, to cover the first inner area 135 thereof.

Figure 8A:
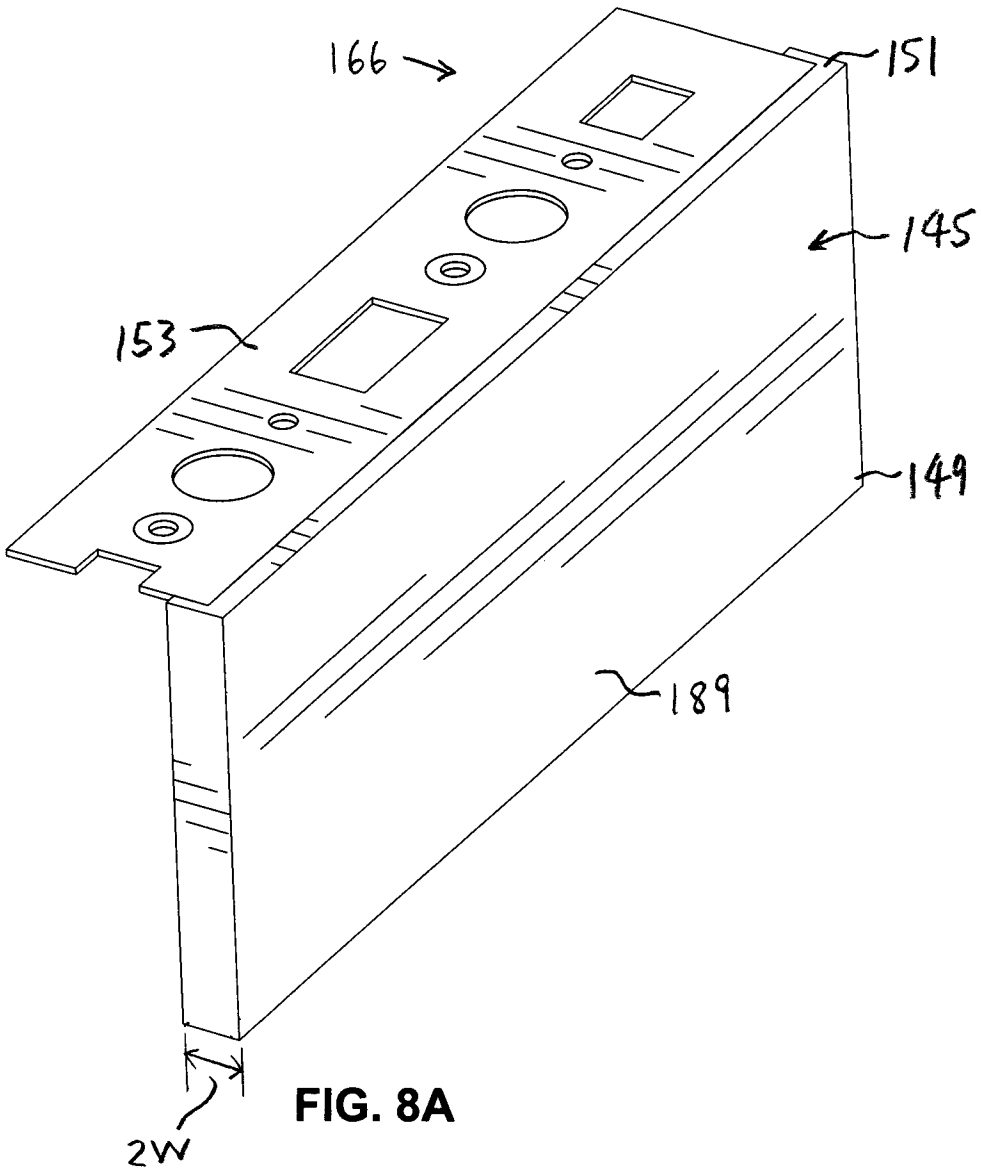
FIG. 8A is an isometric view of an embodiment of a second inner insert element of the invention.
Figure 8B:
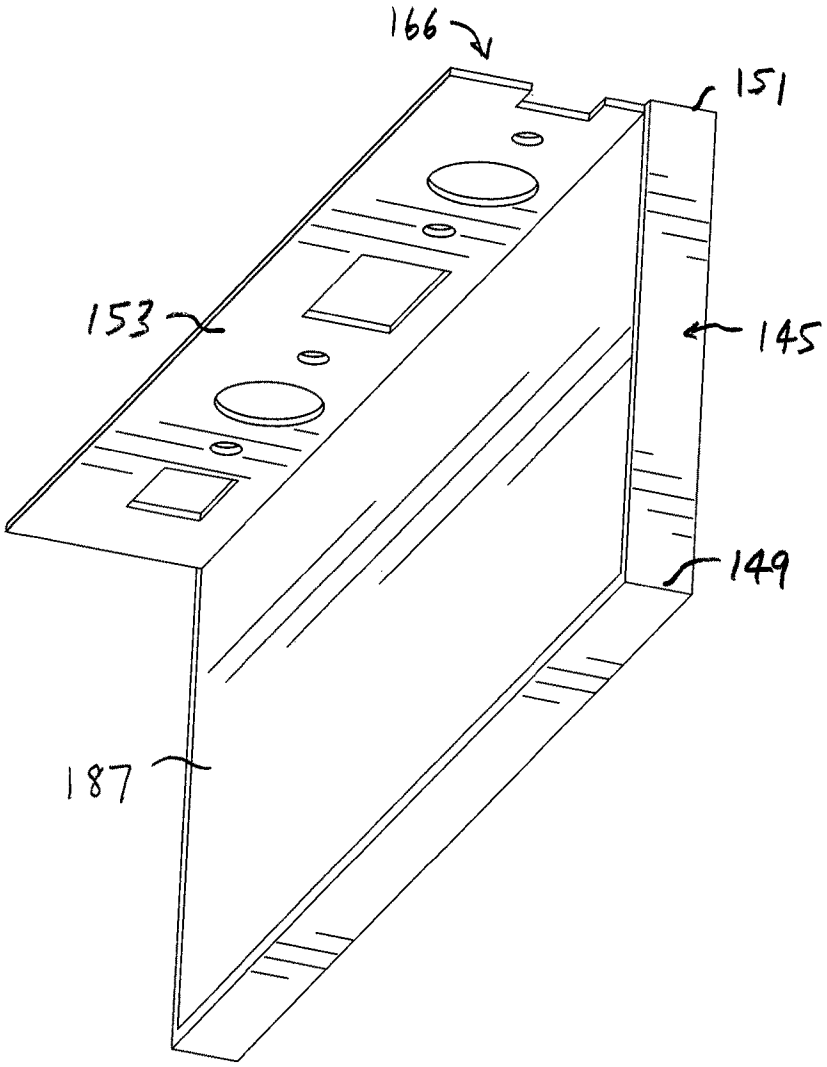
FIG. 8B is another isometric view of the second inner insert element of FIG. 8A.

As can be seen in FIGS. 8A and 8B, the second inner insert element 166 preferably includes a second inner insert wall segment 145, for covering a predetermined first inner area 147 (FIG. 4E) of the leading interior wall surface "$IWS_2$". Preferably, the second inner insert wall segment 145 extends between an internal side 149 thereof positionable proximal to the floor surface 48, and an external side 151 thereof, located distal to the internal side 149.

It will be understood that the second inner portion 170 of the pulp chamber surfaces "PCS" includes the first inner area 147 of the leading interior wall surface "$IWS_2$".

Preferably, and as can be seen in FIGS. 8A and 8B, the second inner insert element 166 additionally includes a second inner insert flange 153 secured to the external side 151, for engaging the exterior part 180 (FIG. 4E) of the leading interior wall 32. Preferably, the second inner insert flange 153 includes apertures 155 therein, for receiving the fasteners 142, to secure the second inner insert element 166 to the leading interior wall 32.

It will be understood that the first inner insert element 164 may, alternatively, be secured to the leading interior wall 32, and the second inner insert element 166 may be secured to the trailing interior wall 30. The first inner insert element 164 preferably is secured to an interior wall that is opposed to the interior wall to which the first outer insert element 156 is attached. Because it is anticipated that most of the wear occurs in the area of the leading interior wall and the floor near to the outer wall 50 of the pulp chamber 22, it is preferred that the first outer insert element 156 is formed to fit onto the leading interior wall 32, as this permits the reinforced regions 125 to be positioned on the areas of the first outer insert element 156 where the greatest wear is expected to occur.

As can be seen in FIG. 7A, the first inner insert element 164 preferably is partially defined along an open side "2OS" thereof by a lateral edge 183, formed to be spaced apart from the leading interior wall 32 when the first inner insert element 164 is installed in the pulp chamber 22. The edge 183 extends along the first inner insert floor segment 127. In one embodiment, the first inner insert floor segment 127 preferably also includes a platform 185 that projects toward the leading interior wall 32, when the first inner insert element 164 is installed in the pulp chamber 22. The open side of the first inner insert element 164 is also partially defined by the platform 185. As can be seen in FIG. 7A, it is preferred that the platform 185 extends beyond the lateral edge 183 by a distance "2D".

In one embodiment, the first inner insert floor segment 127 preferably is formed to cooperate with the second inner insert wall segment 145 to form the continuous lining "$2L_I$" over the first and second inner portions 168, 170 of the pulp chamber surfaces "PCS".

As can be seen in FIG. 8A, it is preferred that the second inner insert wall segment 145 has a width "2W" at its internal side 149 that is less than the distance "2D". As will be described, the internal side 149 of the second inner wall segment 145 is formed to be received on the platform 185 once the first inner insert element 164 has been installed in the pulp chamber 22.

It is preferred that the first inner insert element 164 is installed in the pulp chamber 22, and the second inner insert element 166 is subsequently installed. Preferably, and as can be seen in FIG. 9A, when the first inner insert element 164 is installed in the pulp chamber 22, the platform 185 abuts, or almost abuts, the leading interior wall 32.

In this embodiment, the first and second inner insert elements 164, 166 cooperate to form the lining "$2L_I$" by fitting together, as can be seen in FIG. 9C, so that the first and second inner portions 168, 170 of the pulp chamber surfaces "PCS" are covered by the installed first and second inner insert elements 164, 166.

As can be seen in FIGS. 8A and 8B, the second inner insert wall segment 145 preferably has opposed interior and exterior sides 187, 189. When the second inner insert element 164 is installed in the pulp chamber 22, the interior side 187 preferably engages the inner area 147 of the trailing interior wall surface "$IWS_2$", covering the area 147. Also, when the second outer insert element 164 is installed in the pulp chamber 22, the exterior side 189 preferably engages the first inner insert floor segment 127 along the edge 183 of the open side "2OS".

Figure 7B:
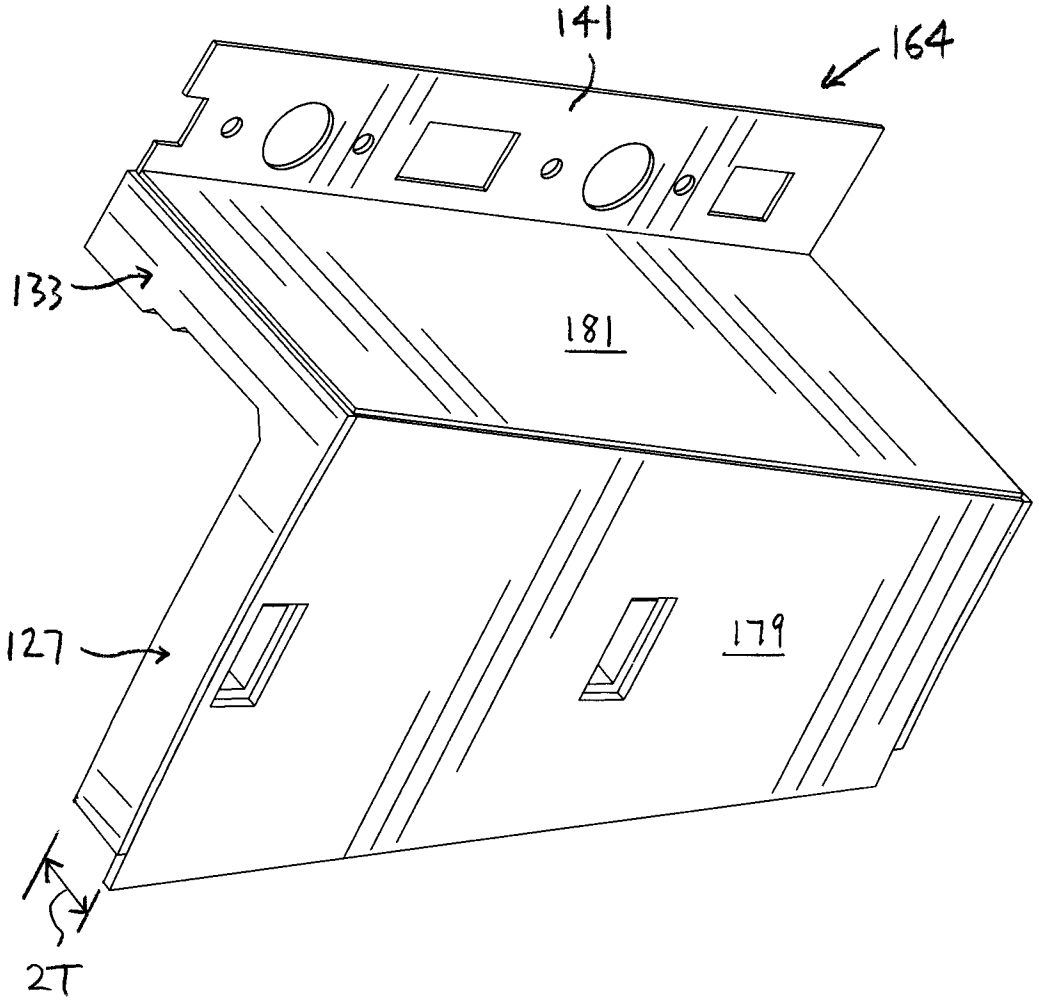
FIG. 7B is another isometric view of the first inner insert element of FIG. 7A.

As can be seen in FIGS. 7A and 7B, the edge 183 is spaced apart from the platform 185 by a thickness "2T" of the floor segment 127 (FIG. 7B), and as a result a surface "2S" is located proximal to the platform 185, and orthogonal to the platform 185. It will be understood that, when the first and second inner insert elements 164, 166 are installed in the pulp chamber 22, a portion 191 of the exterior side 189 of the wall segment 145 engages the surface "2S" (FIG. 9A). The balance of the exterior side 189 forms part of the lining "$2L_I$", and is subjected to wear by the slurry.

As can be seen in FIG. 1A, the grinding mill 26 includes a mill shell 93, which includes the discharge end wall 24 in which a number of pulp chambers are formed. It will be understood that the pulp chamber insert assemblies of the invention may be installed in all, or only some, of the pulp chambers in the discharge end wall. In use, a charge "B" is introduced into a mill shell chamber "C" in the mill shell 93, as indicated by arrow "G". The charge "B" may fill the mill shell chamber "C" to a depth "H" (FIG. 1A). As the mill shell 93 rotates about the axis 28, ore and waste in the charge "B" is ground into finer ore and waste particles that are included in the pulp or slurry that ultimately flows through discharge grates 59 into the pulp chambers, as indicated by arrows "J" in FIGS. 1A and 1B. Those skilled in the art would appreciate that, when a pulp chamber is raised above the opening 29, the slurry in it flows toward the opening 29. As indicated by arrows "K" in FIGS. 1A and 1B, the slurry, or at least a portion thereof, flows from the pulp chamber to the opening 29, to exit the grinding mill 26 via the opening 29.

The insert elements may be made of any suitable material, or suitable combinations of materials. The material or materials used preferably are selected at least in part for their ability to resist the wear to which the pulp chamber insert is subjected by the solid particles in the slurry. It will be understood that the insert elements are made of highly wear-resistant material or materials. For example, the insert elements may be rubber or steel or any suitable combination thereof, and the insert elements may have any suitable thickness or thicknesses. In each grinding mill, the parameters may differ widely, and the optimum materials and thicknesses thereof is determined according to a number of factors specific to the mill. The pulp chamber insert assemblies of the invention may be formed for installation in a particular pulp chamber, i.e., taking into account the patterns of wear expected or observed in that particular pulp chamber.

Figure 10:
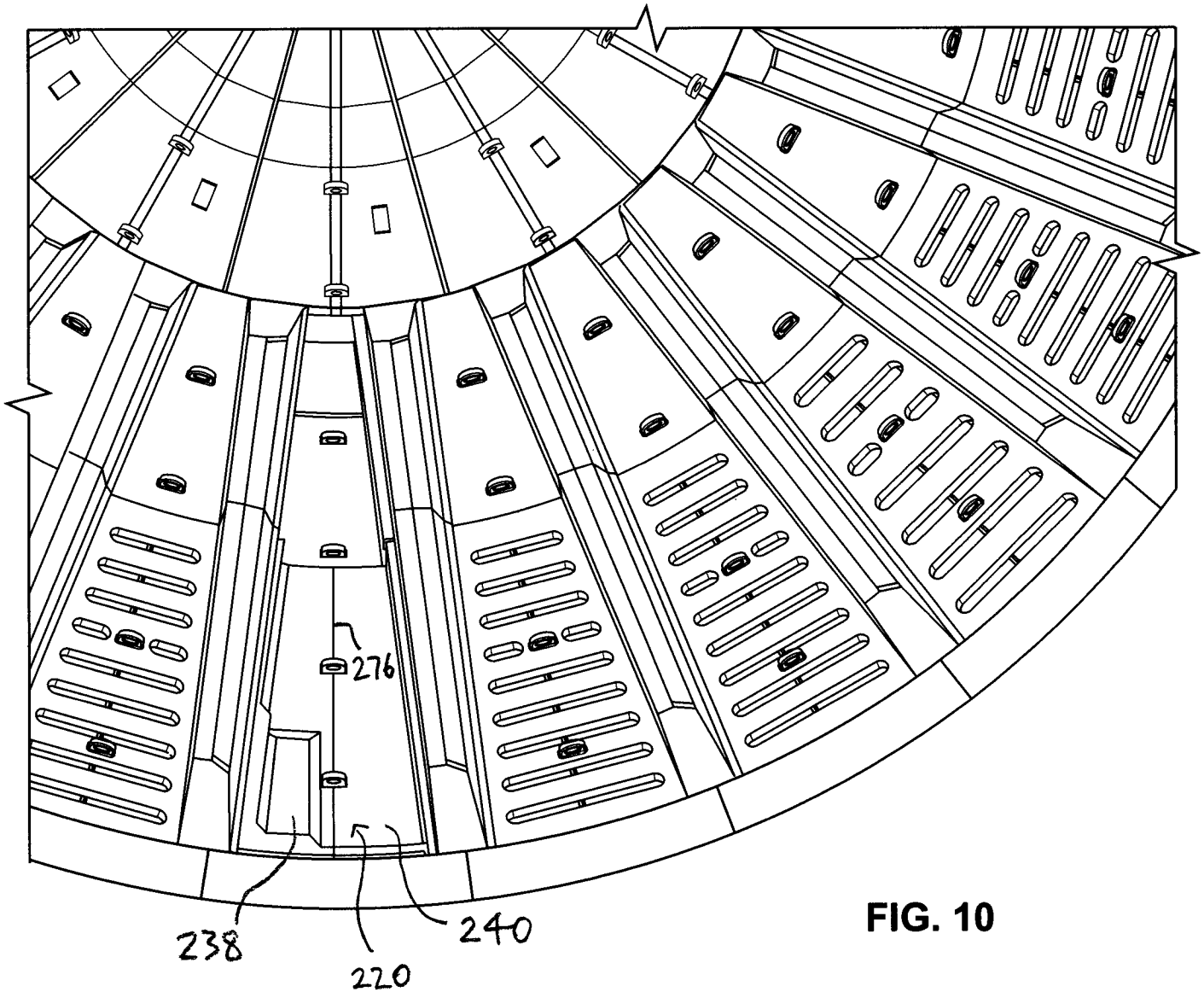
FIG. 10 is an isometric view of an alternative embodiment of the split pulp chamber insert assembly of the invention installed in a pulp chamber, drawn at a smaller scale.

As noted above, the insert elements in the split pulp chamber insert assembly may have any suitable configuration. An example of an alternative split pulp chamber insert assembly 220 is illustrated in FIG. 10. As can be seen in FIG. 10, the split pulp chamber insert assembly 220 preferably includes first and second insert elements 238, 240 that fit together in the pulp chamber. In this embodiment, the first and second insert elements 238, 240 each cover approximately half of the pulp chamber surfaces. When installed, the first and second insert elements 238, 240 define a joint or seam 276 between them.

To install the split pulp chamber assembly in a pulp chamber, two or more insert elements (e.g., the first and second insert elements 38, 40) are provided. As described above, the two insert elements 38, 40 preferably are configured to cooperate to form the lining "L" that at least partially covers one or more preselected portions of the pulp chamber surfaces "PCS" that partially define the pulp chamber 22.

Preferably, the two insert elements 38, 40 are positioned in the pulp chamber 22, to form the lining "L", as noted above. With a number of fasteners 42, the insert elements 38, 40 are secured in the pulp chamber 22. The insert elements 38, 40 cooperate to form the lining "L", covering the preselected portions of the pulp chamber surfaces "PCS". Preferably, the insert elements fit together when installed in the pulp chamber to cover the preselected portions.

As noted above, the split pulp chamber insert assembly of the invention is formed for convenient installation and removal. Over time, the insert elements become worn down due to the wear to which they are subjected, and the split pulp chamber insert assembly is then removed. The split pulp chamber insert assembly of the invention is designed so that it can be removed relatively easily.

To remove the split pulp chamber assembly, the exterior portions 55, 57 of the leading and trailing pulp lifters 34, 36 are removed, and the blind plate 61 and the discharge grate 59 are also removed. The fasteners are loosened or removed, to permit removal of the insert elements of the split pulp chamber assembly from the pulp chamber 22.

As noted above, when the insert elements are installed, they fit together and cooperate with each other to form the lining of the pulp chamber. Also as noted above, the lining formed by the installed insert elements in the pulp chamber 22 may be interrupted by a seam or joint between the insert elements. The installed insert elements may be difficult to remove, even after the fasteners have been removed, due to fines from the slurry filling seams or joints. To disengage the insert elements from each other, a tool (not shown) may be at least partially inserted into the seam or joint between them. With the tool, the seam is widened, and the insert elements may be pried apart, to disengage the insert elements from each other. Once the insert elements are disengaged, they are then removed from the pulp chamber 22.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A grinding mill (26) rotatable about an axis (28) thereof in a direction of rotation, the grinding mill comprising:

a discharge end wall (24) having a discharge opening (29) aligned with the axis, a plurality of pulp lifters radially positioned on the discharge end wall relative to the axis, the pulp lifters being arranged in respective pairs around the axis, each said pair of the pulp lifters (34, 36) including a leading pulp lifter (34) and a trailing pulp lifter (36) relative to the direction of rotation to partially define a pulp chamber (22) therebetween, the pulp chamber (22) being partially defined by a plurality of pulp chamber surfaces (PCS) for directing slurry through the pulp chamber toward the discharge opening (29) that include opposed pulp lifter wall surfaces ($IWS_1$, $IWS_2$) on the respective interior walls (30, 32) of the leading and trailing pulp lifters, a floor surface (48) between the pulp lifter wall surfaces, and an outer wall surface (50) located distal to the discharge opening (29), the grinding mill comprising a plurality of split pulp chamber insert assemblies (120) installed in the respective pulp chambers, each said split pulp chamber insert assembly comprising:

an outer insert subassembly (152) formed for installation in the pulp chamber (22) proximal to the outer wall surface (50), the outer insert subassembly (152) comprising:

a first outer insert element, (156) configured for location on a preselected first outer portion (160) of the pulp chamber surfaces (PCS), the first outer insert element comprising:

a first outer insert floor segment (182), for covering a predetermined first outer area (184) of the floor surface (48);

a first outer insert wall segment (186), for covering a predetermined first outer area (188) of a leading interior wall surface ($IWS_2$) of the trailing pulp lifter, the first outer insert wall segment (186) extending between an internal side (190) thereof connected with the first outer insert floor segment (182), and an external side (192) thereof, located distal to the outer insert floor segment (182), wherein the first outer portion (160) comprises said first outer areas of the floor surface and the leading interior wall surface;

a first outer insert flange (194) secured to the external side (192), for engaging the exterior part (180) of the leading interior wall (33) that is distal to the floor surface (48), the first outer insert flange comprising apertures (196) therein, for receiving fasteners (142) to secure the first outer insert element (156) to the leading interior wall (33);

a second outer insert element (158) configured for location on a preselected second outer portion (162) of the pulp chamber surfaces (PCS), the second outer insert element comprising:

a second outer insert wall segment (101), for covering a predetermined first outer area (103) of the trailing interior wall surface ($IWS_1$), the second outer insert wall segment (101) extending between an internal side (105) thereof positionable proximal to the floor surface (48), and an external side (107) thereof, located distal to the internal side (105), wherein the second outer portion (162) comprises the first outer area (103) of the trailing interior wall surface ($IWS_1$);

a second outer insert flange (109) secured to the external side (107), for engaging the exterior part (199) of the trailing interior wall (30) that is distal to the floor surface (48), the second outer insert flange (109) comprising apertures (111) therein, for receiving the fasteners (142) to secure the second outer insert element (158) to the trailing interior wall (30);

the first outer insert element (156) being partially defined along an open side (OS) by an outer lateral edge (113) extending along the first outer insert floor segment (182) that is engaged by a portion (171) of the exterior side (169) of the second outer insert wall segment (101), wherein the first and second outer insert elements (156, 158) cooperate with each other when installed in the pulp chamber (22) to provide an outer lining ($2L_0$) in the pulp chamber (22) that covers the first and second outer portions (160, 162) of the pulp chamber surfaces (PCS), wherein the first and second insert elements are located to be subjected to wear by the slurry directed through the pulp chamber (22); and a plurality of the fasteners (142), for securing the first and second outer insert elements (156, 158) in the pulp chamber (22).

2. A grinding mill according to claim 1 in which each said split pulp chamber insert assembly additionally comprises:

an inner insert subassembly (154) formed for location thereof in the pulp chamber (22) between the outer insert subassembly (152) and the discharge opening (29), the inner insert subassembly (154) comprising:

at least two inner insert elements, comprising:

a first inner insert element (164) configured for location on a preselected first inner portion (168) of the pulp chamber surfaces (PCS), the first inner insert element comprising:

a first inner insert floor segment (127), for covering a predetermined first inner area (132) of the floor surface (48);

a first inner insert wall segment (133), for covering a predetermined first inner area (135) of the trailing interior wall surface ($IWS_1$), the first inner insert wall segment extending between an internal side (137) thereof connected with the first inner insert floor segment (127), and an external side (139) thereof, located distal to the internal side (137), wherein the first inner portion (168) comprises the first inner floor area (131) of the floor surface and the first inner wall area (135) of the trailing interior wall surface;

a first inner insert flange (141) secured to the external side, for engaging the exterior part of the trailing interior wall, the first inner insert flange comprising apertures therein, for receiving the inner fasteners to secure the first inner insert element to the trailing interior wall;

a second inner insert element (166) configured for location on a preselected second inner portion (170) of the pulp chamber surfaces (PCS), the second inner insert element comprising:

a second inner insert wall segment (145), for covering a predetermined first inner area (147) of the leading interior wall surface ($IWS_2$), the second inner insert wall segment (145) extending between an internal side (149) thereof positionable proximal to the floor surface (48), and an external side (151) thereof, located distal to the internal side (149), wherein the second inner portion (170) comprises the first inner area (147) of the leading interior wall surface ($IWS_2$); a second inner insert flange (153) secured to the external side (151), for engaging the exterior part (180) of the leading interior wall (32), the second inner insert flange (153) comprising apertures (155) therein, for receiving the fasteners (142) to secure the second inner insert element (166) to the leading interior wall (32);

the first inner insert element (164) being partially defined along an open side (2OS) thereof by an inner lateral edge (183) extending along the first inner insert floor segment (127) that is engaged by a portion (191) of the exterior side (189) of the second inner insert wall segment (145), wherein the first and second inner insert elements (164, 166) cooperate with each other when installed in the pulp chamber (22) form an inner lining ($2L_1$) in the pulp chamber (22) covering the first and second portions (168, 170) of the pulp chamber surfaces (PCS), wherein the first and second inner insert elements are subjected to wear by the slurry directed through the pulp chamber; and a plurality of the fasteners, for securing said at least two inner insert elements in the pulp chamber between the outer insert subassembly and the discharge opening.

3. The grinding mill according to claim 2 in which:

the first outer insert element (156) additionally comprises a first outer insert outer wall segment (121); and the first outer insert floor segment (182) and the first outer insert outer wall segment (121) are formed to cooperate with the second outer insert wall segment (101) to form the continuous lining ($2L_0$) over the first and second outer portions (160, 162) of the pulp chamber surfaces (PCS).

4. The grinding mill according to claim 3 in which the first inner insert floor segment (127) comprises a platform (185) that is formed to receive the internal side (149) of the second inner insert floor segment (145).

5. The grinding mill according to claim 3 in which the first outer insert floor segment (182) comprises a platform (115) that is formed to receive the internal side (105) of the second outer insert wall segment (101) thereon.

6. The grinding mill according to claim 5 in which:

the platform (115) extends beyond the lateral edge (113) by a predetermined distance (D), wherein the internal side (105) is receivable on the platform (115) between the edge (113) and the trailing wall surface (30).

7. The grinding mill according to claim 6 in which:

a portion (171) of the exterior side (169) of the second outer insert wall segment (101) is formed for engagement with the surface (S) when the internal side (105) of the second outer insert wall segment (101) is received in the slot (Q).

8. The grinding mill according to claim 3 in which:

the lateral edge (113') is spaced apart from the trailing interior wall (30) when the first outer insert element (156') is secured in the pulp chamber (22), to define a slot (Q) between the lateral edge (113') and the trailing interior wall (30) in which the internal side (105) of the second outer insert wall segment (101) is receivable.

9. The grinding mill according to claim 2 in which the first outer insert element (156) additionally comprises a first outer insert outer wall segment (121), for covering a predetermined area (123) of the outer wall surface (50), the first outer insert outer wall segment (121) being connected with the first outer insert floor segment (182) and the first outer insert wall segment (186).

10. The grinding mill according to claim 9 in which at least a selected one of the first outer insert element (156) and the second outer insert element (158) additionally comprises at least one reinforced region (125) thereof, for mitigating wear to which the outer insert subassembly (152) is subjected.

11. The grinding mill according to claim 10 in which said at least one reinforced region (125) is formed in the first outer insert floor segment (182) and is located proximal to the first outer insert outer wall segment (186).

12. The grinding mill according to claim 10 in which said at least one reinforced region (125) is formed in the first outer insert wall segment (186) and is located proximal to the first outer insert outer wall segment (121).

13. The grinding mill according to claim 10 in which said at least one reinforced region (125) is formed in the first outer insert outer wall segment (121) and is located proximal to the first outer insert wall segment (186).

14. The grinding mill according to claim 2 in which the first outer insert floor segment (182) comprises a lateral edge (113') that is spaced apart from the trailing interior wall (30) when the first outer insert element (156') is secured in the pulp chamber (22) to define a slot (Q) between the lateral edge (113') and the trailing interior wall (30) in which the internal side (105) of the second outer insert wall segment (101) is receivable.

15. A grinding mill (26) rotatable about an axis (26) thereof in a direction of rotation, the grinding mill comprising:

a discharge end wall (24) having a discharge opening (29) aligned with the axis, a plurality of pulp lifters radially positioned on the discharge end wall relative to the axis, the pulp lifters being arranged in respective pairs around the axis, each said pair of the pulp lifters (34, 36) including a leading pulp lifter (34) and a trailing pulp lifter (36) relative to the direction of rotation to partially define a pulp chamber (22) therebetween, the pulp chamber (22) being partially defined by a plurality of pulp chamber surfaces (PCS) for directing slurry through the pulp chamber toward the discharge opening (29) that include opposed pulp lifter wall surfaces ($IWS_1$, $IWS_2$) on the respective interior walls (30, 32) of the leading and trailing pulp lifters, a floor surface (48) between the pulp lifter wall surfaces, and an outer wall surface (50) located distal to the discharge opening (29), the grinding mill comprising a plurality of split pulp chamber insert assemblies (120) installed in the respective pulp chambers, each said split pulp chamber insert assembly (20) comprising:

a first insert element (38) formed to cover a first portion (44) of the pulp chamber surfaces (PCS), said first portion (44) including:

the floor surface (48);

the outer wall surface (50);

the interior wall surface ($IWS_2$) of the leading interior wall (32);

a second insert element (40) formed to cover a second portion (46) of the pulp chamber surfaces (PCS), said second portion (46) including the interior wall surface ($IWS_1$) of the trailing interior wall (30);

the first and second insert elements (38, 40) being secured in the pulp chamber (22) by a plurality of fasteners (142); and the first and second insert elements (38, 40) being formed to cooperate with each other to form a lining (L) covering the first and second portions (44, 46) of the pulp chamber surfaces (PCS).

* * * * *